US010315423B2

(12) United States Patent
Murayama et al.

(10) Patent No.: US 10,315,423 B2
(45) Date of Patent: Jun. 11, 2019

(54) RECORDING DEVICE AND RECORDING METHOD

(71) Applicant: CANON KABUSHIKI KAISHA, Tokyo (JP)

(72) Inventors: Yoshiaki Murayama, Tokyo (JP); Atsuhiko Masuyama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/936,101

(22) Filed: Mar. 26, 2018

(65) Prior Publication Data

US 2018/0281412 A1 Oct. 4, 2018

(30) Foreign Application Priority Data

Mar. 31, 2017 (JP) ..... 2017-072377

(51) Int. Cl.

| | |
|---|---|
| ***B41J 2/155*** | (2006.01) |
| ***B41J 2/045*** | (2006.01) |
| ***B41J 29/38*** | (2006.01) |
| ***B41J 2/21*** | (2006.01) |
| ***B41J 2/515*** | (2006.01) |

(52) U.S. Cl.

CPC ..... *B41J 2/155* (2013.01); *B41J 2/0458* (2013.01); *B41J 2/2132* (2013.01); *B41J 2/2146* (2013.01); *B41J 2/515* (2013.01)

(58) Field of Classification Search

CPC ..... B41J 2/155; B41J 2/0458; B41J 2/04563; B41J 29/38

USPC ..... 347/5, 9–11, 14

See application file for complete search history.

(56) References Cited

U.S. PATENT DOCUMENTS

| | | | | |
|---|---|---|---|---|
| 6,871,934 | B2 * | 3/2005 | Masuyama | B41J 2/0458 347/23 |
| 8,388,090 | B2 * | 3/2013 | Nakajima | B41J 11/425 347/16 |
| 8,705,111 | B2 * | 4/2014 | Masuda | G06K 15/107 358/1.16 |
| 9,317,788 | B2 * | 4/2016 | Akiba | G06K 15/1815 |

FOREIGN PATENT DOCUMENTS

| | | |
|---|---|---|
| JP | 2008247027 A | 10/2008 |
| JP | 2012250552 A | 12/2012 |

* cited by examiner

*Primary Examiner* — An H Do

(74) *Attorney, Agent, or Firm* — Canon U.S.A., Inc. IP Division

(57) ABSTRACT

A recording device includes a recording head having multiple ejection port columns each configured such that multiple ejection ports for ink ejection are arrayed in a predetermined direction. The multiple ejection port columns are arranged in a crossing direction crossing the predetermined direction. An acquisition unit is configured to acquire image data including information corresponding to an image to be recorded and information indicating the attribute of the image. A generation unit is configured to distribute the image data to the multiple ejection port columns based on the attribute to generate recording data corresponding to each of the ejection post columns. The multiple ejection port columns include at least a first ejection port column having a first ejection port, and a second ejection port column arranged at a position different from that of the first ejection port column in the predetermined direction.

20 Claims, 16 Drawing Sheets

| COLUMN | o | e |
|---|---|---|
| 0 | 0 | 1 |
| 1 | 2 | 3 |
| 2 | 4 | 5 |
| 3 | 6 | 7 |
| 4 | 1 | 0 |
| 5 | 3 | 2 |
| 6 | 5 | 4 |
| 7 | 7 | 6 |

| COLUMN | o | e |
|---|---|---|
| 0 | 4 | 5 |
| 1 | 0 | 1 |
| 2 | 2 | 3 |
| 3 | 6 | 7 |
| 4 | 5 | 4 |
| 5 | 1 | 0 |
| 6 | 3 | 2 |
| 7 | 7 | 6 |

| COLUMN | o | e |
|---|---|---|
| 0 | 6 | 7 |
| 1 | 4 | 5 |
| 2 | 0 | 1 |
| 3 | 2 | 3 |
| 4 | 7 | 6 |
| 5 | 5 | 4 |
| 6 | 1 | 0 |
| 7 | 3 | 2 |

| COLUMN | o | e |
|---|---|---|
| 0 | 6 | 7 |
| 1 | 4 | 5 |
| 2 | 2 | 3 |
| 3 | 0 | 1 |
| 4 | 7 | 6 |
| 5 | 5 | 4 |
| 6 | 3 | 2 |
| 7 | 1 | 0 |

FIG. 14A

| COLUMN | o | e |
|---|---|---|
| 0 | 0 | 1 |
| 1 | | |
| 2 | | |
| 3 | | |
| 4 | 1 | 0 |
| 5 | | |
| 6 | | |
| 7 | | |

FIG. 14B

| COLUMN | o | e |
|---|---|---|
| 0 | | |
| 1 | 0 | 1 |
| 2 | | |
| 3 | | |
| 4 | | |
| 5 | 1 | 0 |
| 6 | | |
| 7 | | |

FIG. 14C

| COLUMN | o | e |
|---|---|---|
| 0 | | |
| 1 | | |
| 2 | 0 | 1 |
| 3 | | |
| 4 | | |
| 5 | | |
| 6 | 1 | 0 |
| 7 | | |

FIG. 14D

| COLUMN | o | e |
|---|---|---|
| 0 | | |
| 1 | | |
| 2 | | |
| 3 | 0 | 1 |
| 4 | | |
| 5 | | |
| 6 | | |
| 7 | 1 | 0 |

X

RECORDING DEVICE AND RECORDING METHOD

BACKGROUND OF THE INVENTION

Field of the Invention

The present invention relates to a recording device and a recording method.

Description of the Related Art

A recording device has been typically known, which is configured to record an image on a recording medium by ejecting ink to the recording medium while scanning, relative to the recording medium, a recording head including ejection port columns each having multiple arrayed ejection ports. Recently, it has been known that a recording head configured such that multiple ejection port columns corresponding to the same ink color are arranged in a scanning direction is used in the recording device. According to such a recording device, recording can be performed for the same position on the recording medium by the multiple ejection ports in cooperation with each other. Thus, influence of landing position shifting due to an ejection port manufacturing error can be more reduced as compared to the case of recording only by a single ejection port.

Japanese Patent Laid-Open No. 2008-247027 discloses that a recording head configured such that multiple ejection port columns shift from each other in an ejection port arraying direction is used to cause ejection ports arrayed in the multiple ejection port columns to eject ink to positions different from each other in the arraying direction. According to such a recording head, the ink can be landed on a recording medium with a resolution higher than that of the ejection port per ejection port column.

In a case where ejection is performed on the recording medium at certain timing and subsequent ejection is performed for the same region at another timing, when a lag in recording head scanning or conveyance of the recording medium is caused between these timings, dot formation positions shift from each other between these timings. As a result, unevenness in color density might be caused. In response, it has been known that for reducing unevenness in color density due to shifting of the dot formation positions as described above, dots are not formed at exclusive positions, but some of the dots are formed at the same position between different timings. Note that in a case where some of the dots are formed at the same position between the different timings, when no landing position shifting is caused, image sharpness is lowered as compared to the case of forming the dots at the exclusive positions. Thus, Japanese Patent Laid-Open No. 2012-250552 discloses that image processing is performed such that dots are formed exclusively for, e.g., an image edge portion emphasizing image sharpness and that some of the dots are formed at the same positions for, e.g., an image non-edge portion not emphasizing image sharpness much but emphasizing reduction in unevenness in color density due to landing position shifting.

SUMMARY OF THE INVENTION

In accordance with an aspect of the present invention, it has been determined that in the case of using a recording head configured such that the multiple ejection port columns shift from each other in the ejection port arraying direction, unevenness in color density as described above can be reduced. A case of using a recording head configured such that ejection port columns shift from each other in an arraying direction by 2400 dpi will be described herein.

In accordance with another aspect of the present invention, it has been determined that in the case of using the above-described recording head, dots formed from two ejection ports positioned closest to each other in the arraying direction are formed at positions shifting from each other in the arraying direction by 2400 dpi. An ink droplet ejection volume from the ejection port is generally several pl, and therefore, the diameter of the dot formed on the recording medium is larger than an interval corresponding to 2400 dpi. Thus, some of the dots overlap with each other in the arraying direction. Consequently, unevenness in color density due to dot formation position shifting can be reduced.

However, in accordance with another aspect of the present invention, it has been determined that when the same type of recording is performed for, e.g., a thin line image or a character image, there is a probability that image sharpness is lowered. When the dots are formed at the positions shifting from each other in the arraying direction by 2400 dpi as described above, a single dot line formed by two ejection ports and extending in a direction crossing the arraying direction is formed with blurring corresponding to 2400 dpi. Depending on circumstances, such a line is formed in a zig-zag pattern. Influence of such blurring is smaller in the case of an image not emphasizing sharpness much, such as an image picture. However, there is a probability that the quality of an image such as a thin line image or a character image is greatly lowered due to such a zig-zag shape.

As described above, it has been determined that an image input by a user has various attributes such as a thin line image, a character image, or an image picture, and therefore, preferably different recording methods are used according to these attributes.

In view of the above-described considerations, in accordance with another aspect of the present invention, recording can be performed with reduced non-sharpness and recording can be performed with reduced unevenness in color density according to an image in the case of using a recording head configured such that multiple ejection port columns shift from each other in an arraying direction.

According to another aspect of the present invention, a recording device includes a recording head having multiple ejection port columns each configured such that multiple ejection ports for ink ejection are arrayed in a predetermined direction, the multiple ejection port columns arranged in a crossing direction crossing the predetermined direction; an acquisition unit configured to acquire image data including information corresponding to an image to be recorded and information indicating the attribute of the image; a generation unit configured to distribute the image data to the multiple ejection port columns based on the attribute to generate recording data corresponding to each of the ejection port columns; and a control unit configured to control, according to the recording data, recording operation such that ink is ejected from the multiple ejection port columns. The multiple ejection port columns include at least a first ejection port column having a first ejection port, and a second ejection port column having a second ejection port and arranged at a position different from that of the first ejection port column in the predetermined direction. The second ejection port is at a position different from that of the first ejection port in the predetermined direction, and is, in the predetermined direction, positioned closest to the first ejection port of the ejection ports arrayed in the multiple ejection port columns. The generation unit distributes the image data such that a difference in a recording ratio between the first ejection port column and the second ejection port column is greater in a case where the attribute is a first attribute than in a case where the attribute is a second attribute different from the first attribute.

Further features of the present invention will become apparent from the following description of exemplary embodiments (with reference to the attached drawings).

BRIEF DESCRIPTION OF THE DRAWINGS

FIGS. 14A, 14B, 14C, and 14D are views of the complementary port priority table in the embodiment.

DESCRIPTION OF THE EMBODIMENTS

First Embodiment

Figure 1:
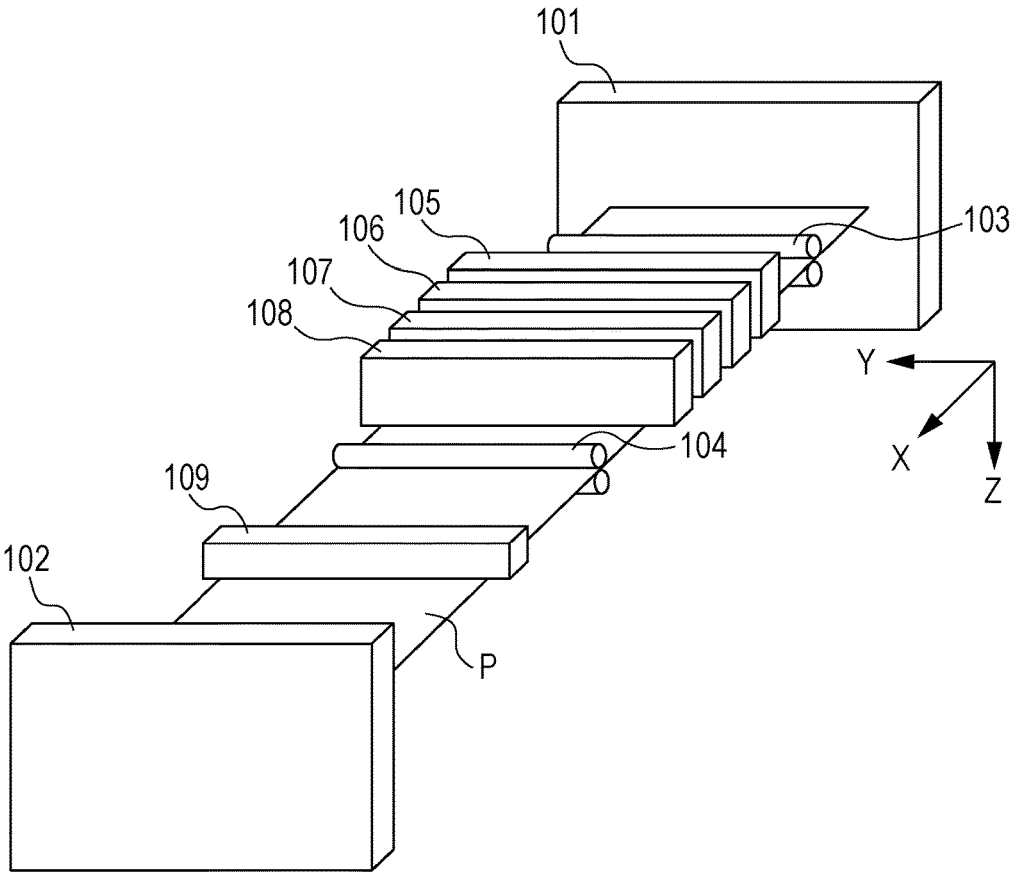
FIG. 1 is a view of an internal configuration of a recording device in an embodiment.

FIG. 1 is a view of an internal configuration of an ink let recording device (hereinafter also referred to as a "recording device") in the present embodiment.

A recording medium P fed from a feeding unit 101 is sandwiched by conveyance roller pairs 103 and 104 while being conveyed in a +X direction (a conveyance direction, a crossing direction) at a predetermined speed, and then, is discharged from a discharging unit 102. Recording heads 105 to 108 are arranged along the conveyance direction between the upstream conveyance roller pair 103 and the downstream conveyance roller pair 104, and are configured to eject ink in a Z direction according to recording data. The recording heads 105, 106, 107, and 108 are configured to discharge ink in cyan, magenta, yellow, and black, respectively. Each type of ink is fed to a corresponding one of the recording heads 105 to 108 through not-shown tubes.

In the present embodiment, the recording medium P may be a continuous sheet held in a roll shape at the feeding unit 101, or may be a sheet cut in a standard size in advance. In the case of the continuous sheet, after recording operation by the recording heads 105 to 108 has ended, the continuous sheet is cut in a predetermined length by a cutter 109, and then, is sorted into a sheet discharging tray by the discharging unit 102 according to a size.

Figure 2:
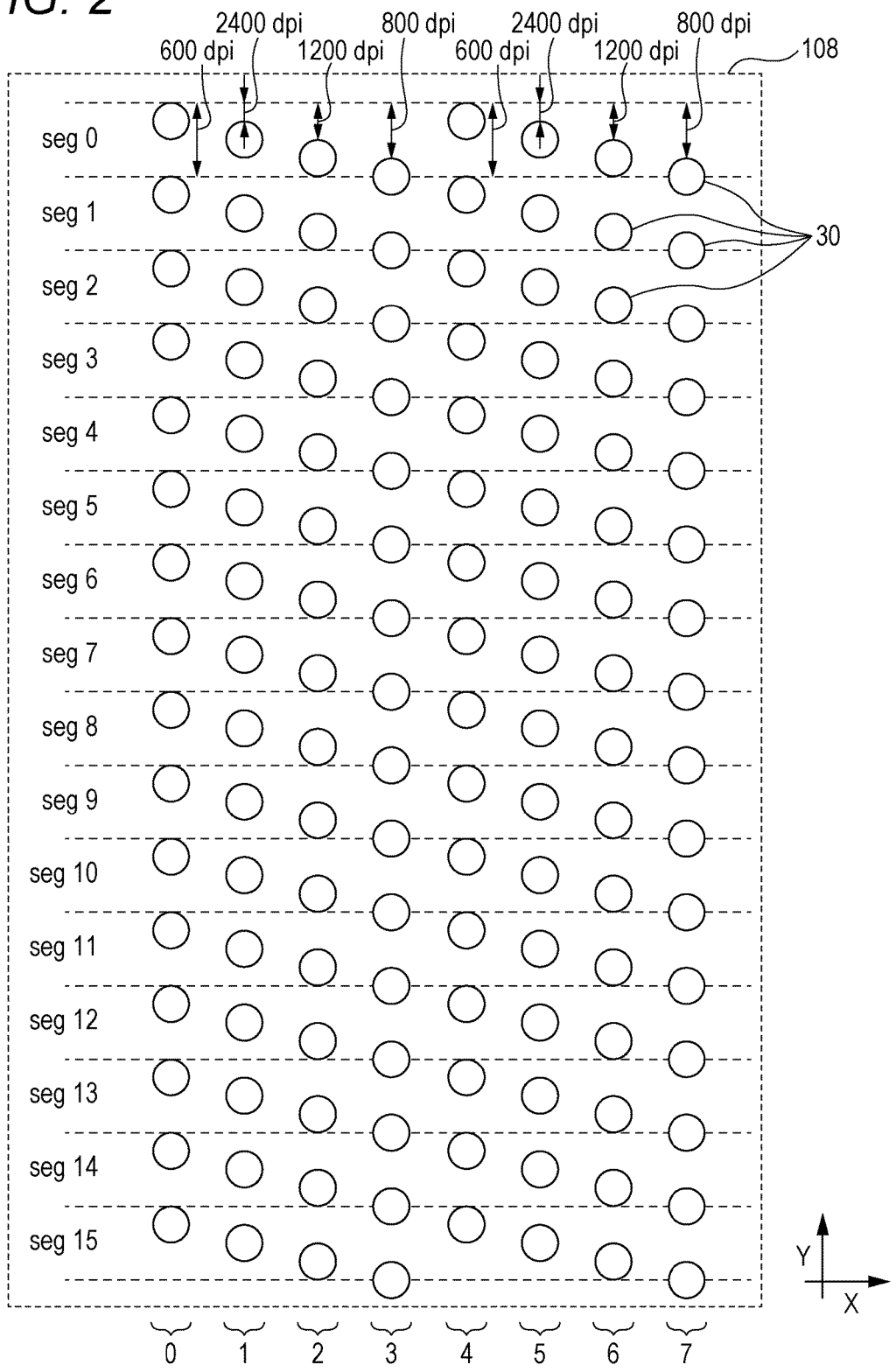
FIG. 2 is a view of a recording head in the embodiment.

FIG. 2 is a view of the recording head in the present embodiment. Note that only the recording head 108 for the black ink among the recording heads 105 to 108 is illustrated herein, but other recording heads 105 to 107 have configurations similar to that of the recording head 108. Electrothermal conversion elements as recording elements are each provided at positions (inside the recording head) each facing ejection ports 30 arranged at the recording head, and are driven to generate thermal energy to perform ink ejection operation. Alternatively, not the electrothermal conversion elements but piezoelectric transducers, electrostatic elements, or MEMS elements may be used.

The recording head 108 is configured such that eight ejection port columns 0 to 7 are arranged in an X direction, the ejection ports 30 for ejecting the ink being arrayed along a Y direction (an arraying direction, a predetermined direction) crossing the X direction in each of the ejection port columns 0 to 7. For the sake of simplicity, a state in which each of the ejection port columns 0 to 7 includes 16 ejection ports 30 is illustrated herein, but the ejection ports 30 are actually arrayed in each of the ejection port columns 0 to 7 across such an area that recording cart be performed for the entire width of the recording medium in the Y direction.

In each of these ejection port columns, each ejection port is arranged with such a resolution that 600 ejection ports 30 are arranged per inch (the above-described resolution is hereinafter referred to as "600 dpi"). Moreover, adjacent two of the ejection port columns in the X direction are arranged such that ejection port intervals shift from each other by a resolution corresponding to a distance of 2400 dpi in the Y direction. For example, the ejection port column 1 shifts from the ejection port column 0 by 2400 dpi in a −Y direction, and the ejection port column 2 shifts from the ejection port column 0 by 1200 (=2400/2) dpi in the −Y direction. Thus, in the recording head 108, each ejection port column is arranged so that dots can be formed at the same position in the Y direction by the ejection port column 0 and the ejection port column 4. Similarly, dots can be also formed at the same position in the Y direction by a pair of ejection port columns 1 and 5, a pair of ejection port columns 2 and 6, and a pair of ejection port columns 3 and 7.

It will be described below that eight ejection ports of the ejection port columns 0 to 7 arrayed at positions in the Y direction are sorted as ejection ports belonging to the same seg as illustrated on the left side of FIG. 2. For example, eight ejection ports 30 of the ejection port columns 0 to 7 positioned at an end portion in a +Y direction are sorted into seg0, and eight ejection ports 30 of the ejection port columns 0 to 7 positioned at an end portion in the −Y direction are sorted into seg15.

Figure 3:
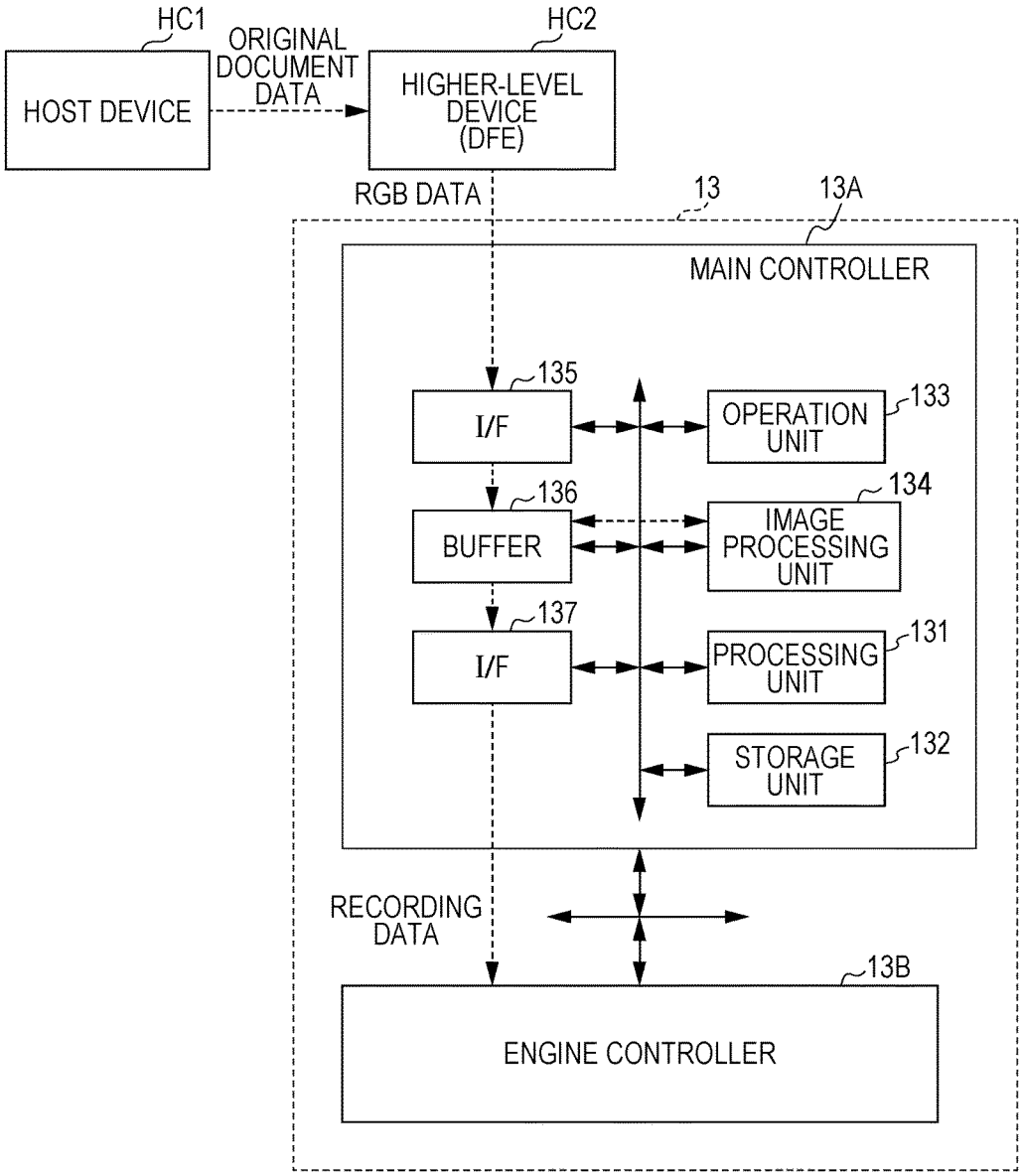
FIG. 3 is a diagram of a recording control system in the embodiment.

FIG. 3 is a block diagram of a recording control system in the present embodiment.

A recording control system 13 in the recording device is communicably connected to a higher-level device (DFE) HC2, and the higher-level device HC2 is communicably connected to a host device HC1.

In the host device HC1, original document data as original data of a recorded image is generated or saved. The original document data described herein is, for example, generated in the format of an electronic file such as a document file or an image file. This original document data is transmitted to the higher-level device HC2. In the higher-level device HC2, the received original document data is converted into a data format available on the recording control system 13, such as RGB data expressing an image in RGB. The converted data is transmitted from the higher-level device HC2 to the recording control system 13 in the recording device.

The recording control system 13 is roughly classified into a main controller 13A and an engine controller 13B. The main controller 13A includes a processing unit 131, a storage unit 132, an operation unit 133, an image processing unit 134, a communication interface (I/F) 135, a buffer 136, and a communication I/F 137.

The processing unit 131 is a processor such as a CPU, and is configured to execute a program stored in the storage unit 132 to control the entirety of the main controller 13A. The storage unit 132 is a storage device such as a RAM, a ROM, a hard drive, or a SSD. The storage unit 132 is configured to store the program to be executed by the processing unit 131 and data and to provide a work area to the processing unit 131. The operation unit 133 is an input device such as a touch panel, a keyboard, or a mouse. The operation unit 133 is configured to receive a user instruction.

The image processing unit 134 is an electronic circuit having an image processing processor, for example. The buffer 136 is a RAM, a hard drive, or a SSD, for example. The communication I/F 135 is configured to communicate with the higher-level device HC2, and the communication I/F 137 is configured to communicate with the engine controller 13B. Dashed arrows in FIG. 3 indicate an example of the flow of processing of data input to the recording control system 13. The data received from the higher-level device HC2 via the communication I/F 135 is accumulated in the buffer 136. The image processing unit 134 reads the data from the buffer 136, and performs predetermined image processing for the read data. In this manner, the image processing unit 134 generates the recording data used by a print engine, and stores such data in the buffer 136 again.

Then, the recording data subjected to the image processing and stored in the buffer 136 is transmitted to the engine controller 13B via the communication I/F 137. Thereafter, the recording elements provided at each of the recording heads 105 to 108 are driven based on the recording data by the engine controller 13B, and in this manner, the recording operation is performed.

Note that the form with the single processing unit 131, the single storage unit 132, and the single image processing unit 134 has been described herein, but a form with multiple processing units 131, multiple storage units 132, and multiple image processing units 134 may be employed.

(Image Processing)

Figure 4:
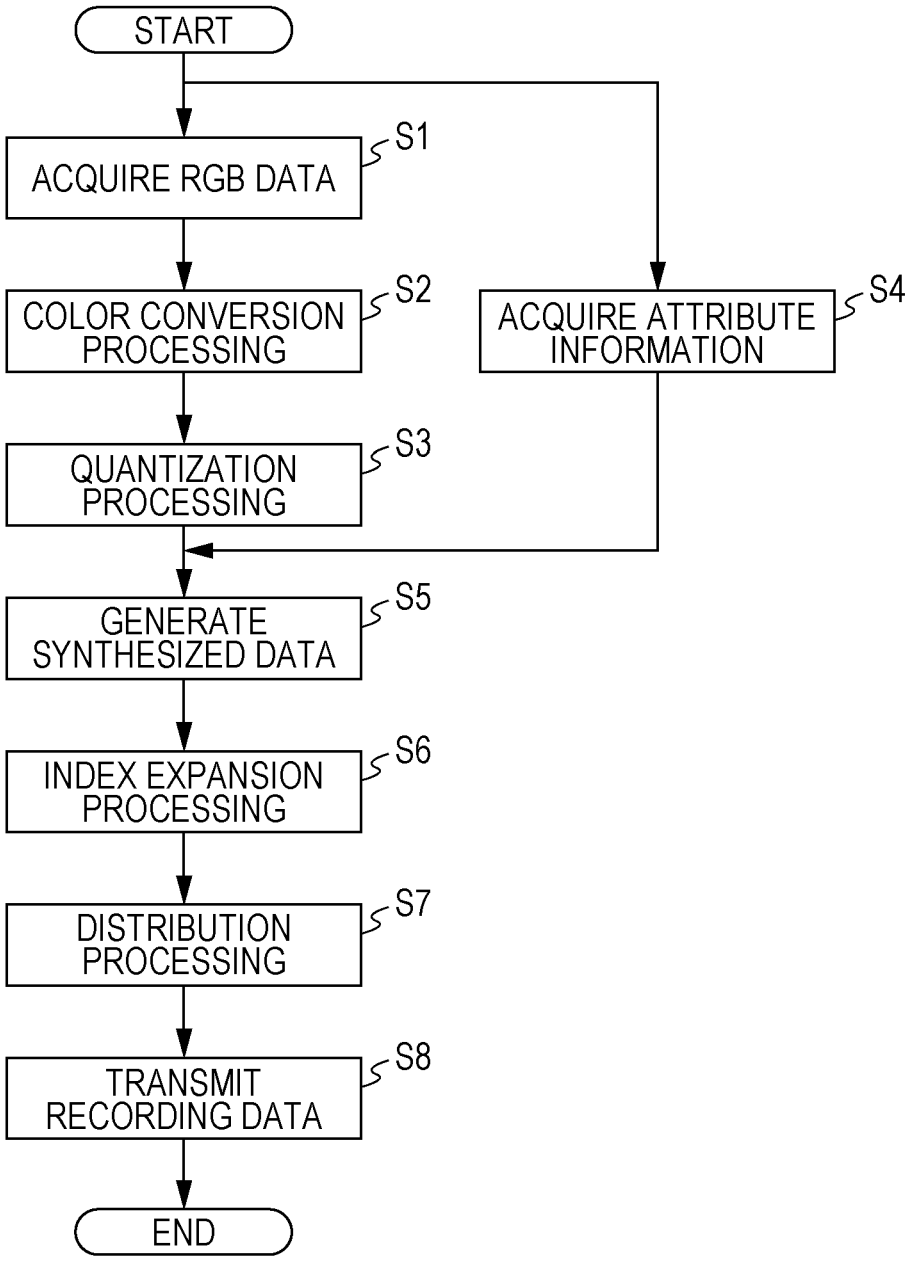
FIG. 4 is a flowchart for describing the process of image processing in the embodiment.

FIG. 4 is a flowchart of a control program for executing data processing in the present embodiment.

When the image processing begins, the image processing unit 134 first acquires, at step S1, the RGB data read from the buffer 136. In the present embodiment, the RGB data includes 8 bits for each value of RGB. Moreover, in the present embodiment, the RGB data has a data resolution of 600 dpi×600 dpi.

Next, at step S2, the color conversion processing of converting the RGB data into CMYK data corresponding to the ink colors used for recording is executed. By such color conversion processing, the CMYK data including 12 bits for each value of CMYK is generated.

Next, at step S3, quantization is performed for the CMYK data to generate quantization data including 3 bits for each value of CMYK. For example, a dither method or an error diffusion method can be executed as this quantization processing. Note that in the present embodiment, the quantization data with a data resolution of 600 dpi is generated by the quantization processing.

Meanwhile, when the image processing begins, attribute information is acquired at step S4 in parallel with steps S1 to S3. The attribute information described herein is information indicating whether the attribute of an image to be recorded in a certain pixel is a character or thin line attribute or other attributes (e.g., an image picture attribute), and includes 1 bit. Specifically, "1" is acquired as the attribute information in a case where a character or a thin line is to be recorded in a certain pixel, and "0" is acquired as the attribute information in a case where other images than the character and the thin line are to be recorded.

In the present embodiment, it has been described that the attribute information is acquired separately from the RGB data. However, the RGB data and the attribute information may be synthesized in advance, and then, may be acquired. Alternatively, a form in which the attribute information is generated based on the RGB data may be employed.

Upon completion of such processing, the quantization data generated by the quantization processing at step S3 and including 3 bits for each value of CMYK and the 1-bit attribute information acquired at step S4 are synthesized at step S5, and in this manner, synthesized data including 4 bits for each value of CMYK is generated. The data resolution of the synthesized data as described herein is the same as that of the quantization data, i.e., 600 dpi×600 dpi.

Next, index expansion processing is performed for the synthesized data at step S6 to generate two planes of image data including the information with 1 bit for each value of CMYK and the 1-bit attribute information. Index expansion in the present embodiment is the processing of using an index pattern to expand two planes of the quantization data of the synthesized data to the data including 1 bit for each value of CMYK and having a resolution of 1200 dpi×1200 dpi, the quantization data including 3 bits for each value of CMYK and having a resolution of 600 dpi×600 dpi. Of the above-described two planes, a plane 1 corresponds to the ejection port columns 0 to 3, and a plane 2 corresponds to the ejection port columns 4 to 7. In other words, in a case where ink ejection is set by image data corresponding to the plane 1, any of the ejection port columns 0 to 3 performs ejection based on such image data. In a case where ink ejection is set by image data corresponding to the plane 2, any of the ejection port columns 4 to 7 performs ejection based on such image data.

Figures 5A, 5B, 5C:
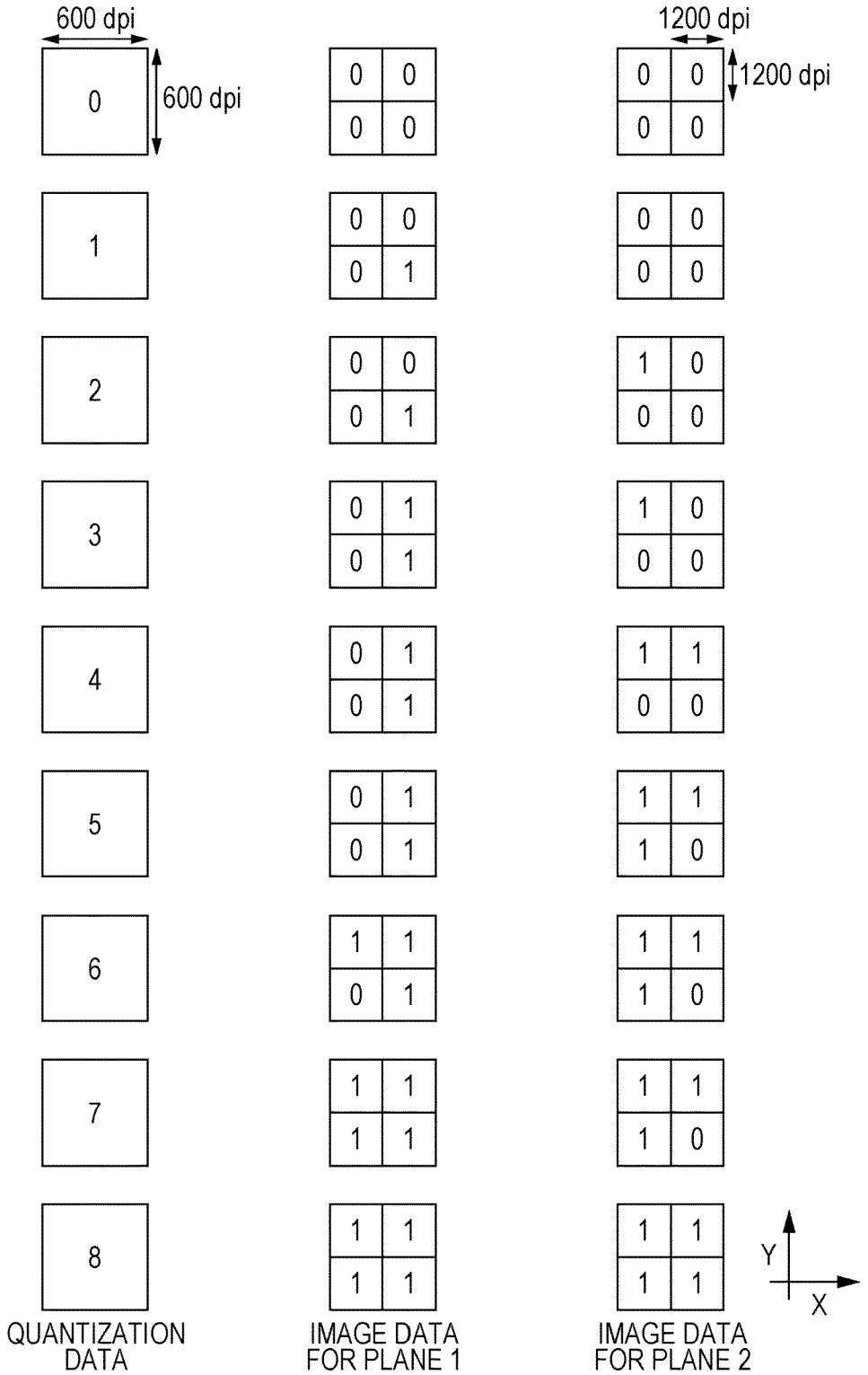
FIGS. 5A, 5B, and 5C are views of an index pattern in the embodiment.

FIGS. 5A, 5B, and 5C are schematic views of the index pattern used in the present embodiment. Of these figures, FIG. 5A illustrates a CMYK value (a gradation value) indicated by the 3-bit information corresponding to the quantization data of the synthesized data. Moreover, FIG. 5B illustrates the index pattern used for expanding the synthesized data for the plane 1 corresponding to the ejection port columns 0 to 3. Further, FIG. 5C illustrates the index pattern used for expanding the synthesized data for the plane 2 corresponding to the ejection port columns 4 to 7.

As will be seen from FIGS. 5A, 5B, and 5C, in a case where the synthesized data with a gradation value of level 0 is input to a region with a resolution of 600 dpi×600 dpi, a value of "0" indicating non-ejection of the ink is, for both of the plane 1 and the plane 2, set for each pixel with a resolution of 1200 dpi×1200 dpi. Next, in a case where the synthesized data with a gradation value of level 1 is input, a value of "1" indicating ejection of the ink is set only for the lower right pixel for the plane 1. Next, in a case where the synthesized data with a gradation value of level 2 is input, a value of "1" is also set for the upper left pixel for the plane 2 in addition to the lower right pixel for the plane 1.

Similarly, the number of pixels for which a value of "1" is set increases by one in any of the planes 1 and 2 as the gradation value of the synthesized data increases by one. In a case where the synthesized data with a gradation value of level 8 as the maximum level is input, a value of "1" is set for all pixels for the planes 1 and 2.

The index expansion processing at step S6 is performed as described above to generate, for each of the planes 1 and 2, the image data including the 1-bit information indicating ejection/non-ejection of the ink with a resolution of 1200 dpi×1200 dpi and the 1-bit attribute information.

Next, at step S7, the distribution processing of distributing the image data for the planes 1 and 2 to any of the ejection port columns 0 to 7 in the recording head is performed to generate the recording data used for recording. In the present embodiment, the recording data includes 1 bit for each value of CMYK, and has a resolution of 1200 dpi×1200 dpi. Such distribution processing will be described later in detail.

Thereafter, the recording data is, at step S8, transmitted to the engine controller 13B, and the recording operation based on the recording data is performed.

Note that the form in which steps S1 to S3 and step S4 are performed in separate processes as illustrated in FIG. 4 has been described, but a form in which the processing of step S4 is performed after the processing of steps S1 to S3 has been performed as illustrated in FIG. 22 may be employed. Alternatively, the timing of performing the processing of step S4 may vary, and for example, the processing may be performed in the order of steps S1, S2, S4, and S3.

(Recording Method According to Image Attribute)

in the present embodiment, different types of distribution processing are executed for the image data according to the image attribute. Specifically, the distribution processing is performed using a first mask pattern for distributing the image data only to specific ejection port columns in a case where the image attribute is the character or thin line attribute (hereinafter also referred to as a "first attribute"), and is performed using a second mask pattern for distributing the image data to all of the ejection port columns in a case where the image attribute is other attributes (hereinafter also referred to as a "second attribute") than the character and thin line attributes, such as the image picture attribute. In the present embodiment, the above-described specific ejection port columns indicate the odd-numbered ejection port columns 1, 3, 5, and 7. Thus, in the present embodiment, an image with the first attribute is recorded by ejection only from the odd-numbered ejection port columns 1, 3, 5, and 7, and an image with the second attribute is recorded by ejection from the ejection port columns 0 to 7.

Figure 6A:
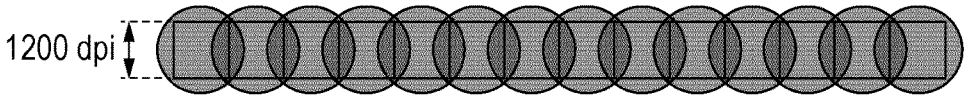
FIGS. 6A, 6B, 6C, and 6D are views for describing the state of dots formed by each recording method.
Figure 6B:
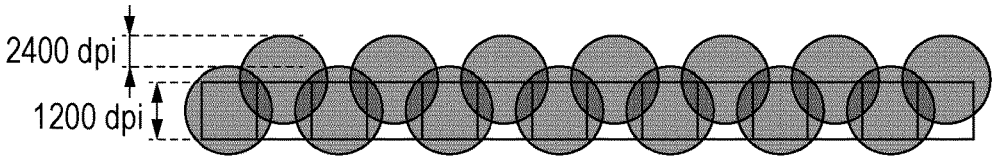
Figure 6C:
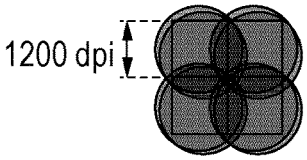
Figure 6D:
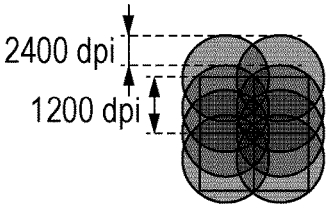
Figure 6D:
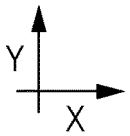

FIGS. 6A, 6B, 6C, and 6D are schematic views of dots formed when the distribution processing is switched when each of the images with the first and second attributes is recorded. Note that achromatic spots of FIGS. 6A, 6B, 6C, and 6D indicate dot formation spots. This also indicates that a higher achromatic color density (closer to black) results in overlapping of more dots. Note that FIGS. 6A and 6B illustrate states when the same number of dots is formed. Similarly, FIGS. 6C and 6D illustrate states when the same number of dots are formed.

FIG. 6A illustrates the dots formed when the image (a thin line image in this example) with the first attribute is recorded only by the ejection port column 3 of the ejection port columns 2 and 3, and FIG. 6B illustrates the dots formed when the image with the first attribute is recorded by the ejection port columns 2 and 3 in cooperation with each other.

As illustrated in FIG. 6A, in the case of using only the ejection port column 3, the dots are formed to extend linearly in the X direction. Thus, the image can be recorded with favorable sharpness.

On the other hand, when recording is performed by the ejection port columns 2 and 3 in cooperation with each other as illustrated in FIG. 6B, the dots are formed in a zig-zag pattern along the X direction. Of the dots illustrated in FIG. 6B, the odd-numbered dots from a −X direction are formed from the ejection port column 3, and the even-numbered dots are formed from the ejection port column 2. As illustrated in FIG. 2, the ejection port columns 2 and 3 shift from each other by 2400 dpi in the Y direction. Thus, although a separation distance is smaller (shorter) than 1200 dpi as the resolution of the recording data, the dots are formed from the ejection port columns 2 and 3 at positions different from each other in the Y direction by 2400 dpi. For this reason, the dots are formed in the zig-zag pattern, leading to lower image sharpness.

FIGS. 6A and 6B show that use of only one of the odd-numbered ejection port column and the even-numbered ejection port column in the case of recording the thin line or the character is preferable because excellent image sharpness can be provided.

On the other hand, FIG. 6C illustrates the dots formed when the image (in this example, an image picture for which the ink is ejected twice for a pixel with a resolution of 1200 dpi×1200 dpi) with the second attribute is recorded only by the odd-numbered ejection port columns 1, 3, 5, and 7, and FIG. 6D illustrates the dots formed when the image with the second attribute is recorded by all of the ejection port columns 0 to 7 in cooperation with each other. Note that FIG. 6C illustrates a case where the ink is provided twice to the same position, but two dots of the ink provided to the same position are, for the sake of simplicity, illustrated as if these dots are slightly separated from each other.

When only the odd-numbered ejection port columns 1, and 3, 5, 7 are used as illustrated in FIG. 6C, the dots are formed only at such positions that the center of each dot is coincident with the center of a pixel with 1200 dpi×1200 dpi. For example, in the upper left pixel illustrated in FIG. 6C, a single dot from the ejection port column 1 and a single dot from the ejection port column 5, i.e., two dots in total, are formed at the same position.

On the other hand, when all of the ejection port columns 0 to 7 are used as illustrated in FIG. 6D, the half of the dots are formed at such positions that the center of each dot is coincident with the center of a pixel with 1200 dpi×1200 dpi, and the remaining dots are formed at such positions that the center of each dot shifts from the center of a pixel with 1200 dpi×1200 dpi in the Y direction by 2400 dpi. For example, in the upper left pixel illustrated in FIG. 6D, a single dot from the ejection port column 0 and a single dot from the ejection port column 1, i.e., two dots in total, are formed at positions shifting from each other in the Y direction by 2400 dpi.

As will be seen from comparison between FIGS. 6C and 6D, the number of layers of overlapping dots at each position is two, four, or eight in FIG. 6C, whereas the number of layers of overlapping dots varies according to a position in FIG. 6D. Thus, even in a case where the dot formation positions shift from each other in FIG. 6D, a color density less changes as compared to that in the case illustrated in FIG. 6C. Thus, unevenness in color density can be reduced.

FIGS. 6C and 6D show that unevenness in color density can be more reduced by use of all of the ejection port columns in the case of recording the image picture etc.

(Details of Distribution Processing)

In view of the above-described point, the distribution processing at step S7 and the ejection port columns to be used for recording vary, in the present embodiment, according to whether the image attribute is the first or second attribute. Specifically, in a case where the attribute information of the image data indicates the first attribute, the image data is distributed only to the odd-numbered ejection port columns 1, 3, 5, and 7 for providing excellent image sharpness. In a case where the attribute information of the image data indicates the second attribute, the image data is distributed to all of the ejection port columns 0 to 7 for reducing unevenness in color density due to shifting of the dot formation positions.

FIGS. 7A, 7B, 7C, and 7D are views of a first mask pattern group used when the image data with the first attribute (e.g., the thin line image attribute) used in the present embodiment is processed. Moreover, FIGS. 8A 8B, 8C, and 8D are views of a second mask pattern group used when the image data with the second attribute (the image picture attribute, etc.) used in the present embodiment is processed. Note that for the sake of simplicity, all of FIGS. 7A, 7B, 7C, and 7D and FIGS. 8A 8B, 8C, and 8D illustrate only the mask pattern groups applied to the image data for the plane 1 of the planes 1 and 2. Moreover, FIGS. 7A, 7B, 7C, and 7D and FIGS. 8A 8B, 8C, and 8D each illustrate mask patterns corresponding to the ejection port columns 0 to 3. Note that in the mask patterns each illustrated in FIGS. 7A, 7B, 7C, and 7D and FIGS. 8A 8B, 8C, and 8D, a black pixel indicates a pixel allowing ejection in a case where ink ejection is set by the image data, and a white pixel indicates a pixel not allowing ejection even when ink ejection is set by the image data.

Figure 7A:
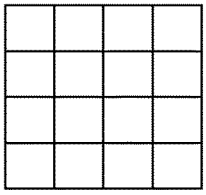
FIGS. 7A, 7B, 7C, and 7D are views of an example of a mask pattern in the embodiment.
Figure 7B:
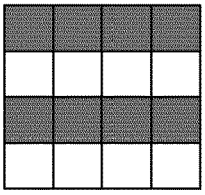
Figure 7C:
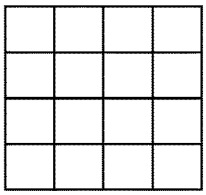
Figure 7D:
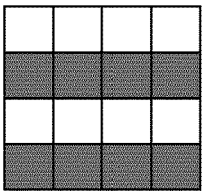
Figure 7D:
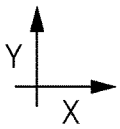
Figure 8A:
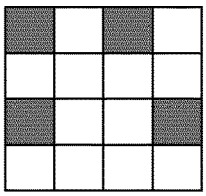
FIGS. 8A, 8B, 8C, and 8D are views of an example of a mask pattern in the embodiment.
Figure 8B:
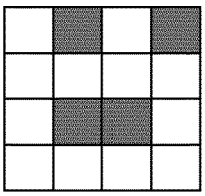
Figure 8C:
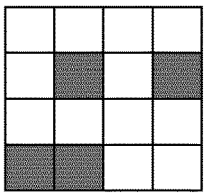
Figure 8D:
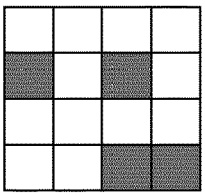
Figure 8D:
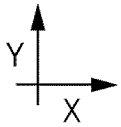

As described above, in the present embodiment, the dots are formed using only the odd-numbered ejection port columns 1, 3, 5, and 7 in the case of recording for the first attribute (e.g., the thin line image attribute). The image data for the plane 1 corresponds to the ejection port columns 0 to 3, and therefore, the image data is distributed only to the ejection port columns 1 and 3 of these ejection port columns. Thus, in the present embodiment, ink ejection is not allowed for the first mask patterns corresponding to the ejection port columns 0 and 2 as illustrated in FIGS. 7A and 7C. On the other hand, ink ejection is allowed for the half of all pixels in the first mask patterns corresponding to the ejection port columns 1 and 3 as illustrated in FIGS. 7B and 7D. Using the first mask pattern group illustrated in FIGS. 7A, 7B, 7C, and 7D, the image data for the plane 1 is not distributed to the ejection port columns 0 and 2, but can be distributed only to the ejection port columns 1 and 3.

On the other hand, in the case of recording for the second attribute (e.g., the image picture attribute), the dots are formed using all of the ejection port columns 0 to 7. Thus, in the present embodiment, in a case where the image data with the second attribute is processed, the image data corresponding to the ejection port columns 0 to 3 is distributed to all of the ejection port columns 0 to 3. Thus, in the present embodiment, ink ejection is allowed for 25% the pixels in the second mask patterns corresponding to the ejection port columns 0 to 3 as illustrated in FIGS. 8A 8B, 8C, and 8D. Using the second mask pattern group illustrated in FIGS. 8A 8B, 8C, and 8D, the image data for the plane 1 can be distributed to all of the ejection port columns 0 to 3.

As described above, in the present embodiment, the mask pattern used in the distribution processing is switched according to the attribute information of the image data, and in this manner, recording is performed in a recording method suitable for each attribute. FIGS. 7A, 7B, 7C, and 7D and FIGS. 8A 8B, 8C, and 8D illustrate the mask patterns each including 4×4 pixel regions by way of example. However, as long as the above-described mask patterns are employed, the size and arrangement of each pixel may vary. Specifically, for the first mask pattern group, the following conditions may be satisfied: ink ejection is not allowed for the mask patterns corresponding to the ejection port columns 0 and 2, and ink ejection is allowed for 50% of the pixels in each of the mask patterns corresponding to the ejection port columns 1 and 3. Moreover, for the second mask pattern group, the following condition may be satisfied: ink ejection is allowed for 25% of the pixels in each of the mask patterns corresponding to the ejection port columns 0 to 3.

Note that the mask pattern groups for processing the image data for the plane 1 corresponding to the ejection port columns 0 to 3 have been described herein, and mask pattern groups satisfying similar conditions are also used when the image data for the plane 2 corresponding to the ejection port columns 4 to 7 is processed.

(Example of Generated Recording Data)

Figure 9:
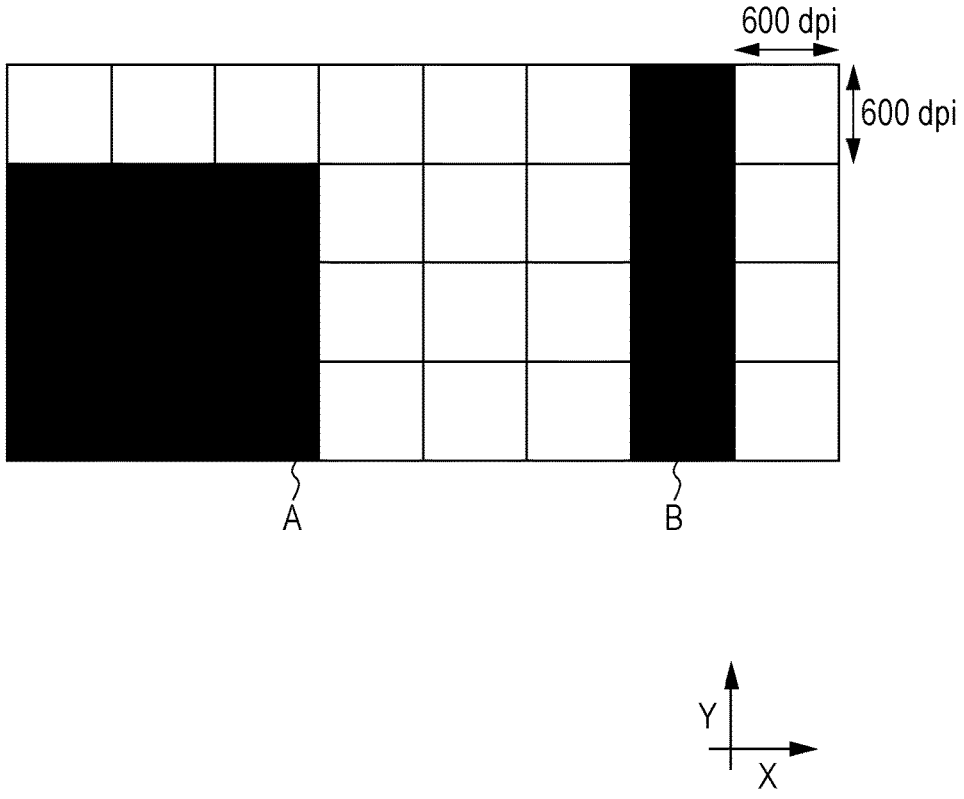
FIG. 9 is a view of an example of image data to be processed in the embodiment.

The recording data generated in the present embodiment when the synthesized data of step S5 is input will be described below with reference to FIG. 9. FIG. 9 is a view of an example of the synthesized data to be processed. Note that in FIG. 9, a black pixel indicates a pixel with a gradation value of level 8, and a white pixel indicates a pixel with a gradation value of level 0.

FIG. 9 illustrates image data containing an image A and an image B. The image A corresponds to the image picture etc., and belongs to the second attribute. Moreover, the image B corresponds to the thin line attribute, and belongs to the first attribute. Each of the images A and B is such an image that the gradation value for each region of 600 dpi×600 dpi in the image is the level 8.

First, the index expansion processing of step S6 is performed. As described with reference to FIGS. 5A, 5B, and 5C, when the synthesized data with a gradation value of level 8 is input to a certain region with 600 dpi×600 dpi, the data allowing ink ejection is generated for four pixels with 1200 dpi×1200 dpi as the image data for both of the planes 1 and 2. Thus, in the case of inputting the synthesized data illustrated in FIG. 9, a single ink ejection by each of the ejection port columns 0 to 3 is, for both of the images A and B, set for each region with 1200 dpi×1200 dpi by the image data for the plane 1, and a single ink ejection by each of the ejection port columns 4 to 7 is set for each region with 1200 dpi×1200 dpi by the image data for the plane 2.

Next, the distribution processing is performed at step S7 to distribute the image data to each of the ejection port columns 0 to 7 to generate the recording data. FIGS. 10A, 10B, 10C, 10D, 10E, 10F, 10G, and 10H each illustrate the recording data generated corresponding to the ejection port columns 0 to 7. Note that in FIGS. 10A, 10B, 10C, 10D, 10E, 10F, 10G, and 10H, a black pixel indicates a pixel to which the ink is to be ejected, and a white pixel indicates a pixel to which the ink is not to be ejected.

First, the image data for the plane 1 sets, for both of the images A and B, a single ink ejection for each region with 1200 dpi×1200 dpi as described above. In this example, the image A belongs to the second attribute (e.g., the image picture attribute), and therefore, the second mask pattern group described by way of example with reference to FIGS. 8A 8B, 8C, and 8D is applied. Thus, the recording data (A0 to A3) is generated for each of the ejection port columns 0 to 3 such that ink ejection is set at a recording ratio of about 25%.

Moreover, the image B belongs to the first attribute (e.g., the thin line image attribute), and therefore, the first mask pattern group described by way of example with reference to FIGS. 7A, 7B, 7C, and 7D is applied. Thus, no ink is ejected from the ejection port columns 0 and 2. In other words, the recording data (B0 and B2) is generated such that the recording ratio is 0%. Moreover, the recording data (B1 and B3) is generated for each of the ejection port columns 1 and 3 such that ink ejection is set at a recording ratio of about 50%.

The same applies to the image data for the plane 2, and for both of the images A and B, a single ink ejection for each region with 1200 dpi×1200 dpi is set. Thus, from the image data corresponding to the image A, the recording data (A4 to A7) is generated for each of the ejection port columns 4 to 7 such that ink ejection is set at a recording ratio of about 25%. Moreover, from the image data corresponding to the image B, the recording data (B4 and B6) is generated for the ejection port columns 4 and 6 such that the recording ratio is 0%, and the recording data (B5 and B7) is generated for the ejection port columns 5 and 7 such that the recording ratio is about 50%.

Figure 10A:
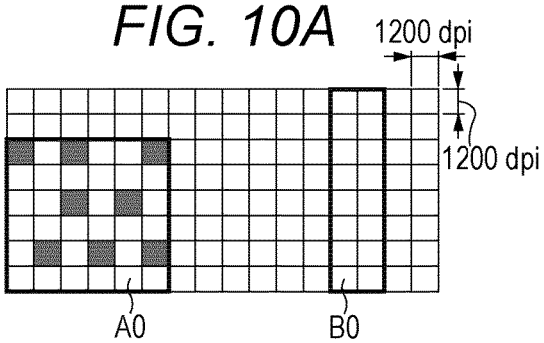
FIGS. 10A, 10B, 10C, 10D, 10E, 10F, 10G, and 10H are views of an example of recording data to be generated in the embodiment.
Figure 10B:
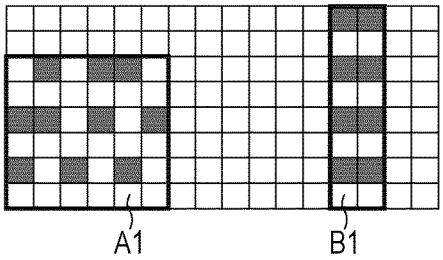
Figure 10C:
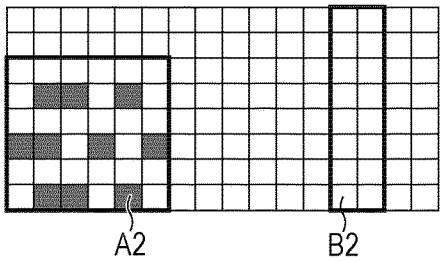
Figure 10D:
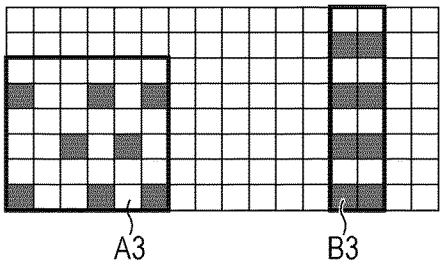
Figure 10E:
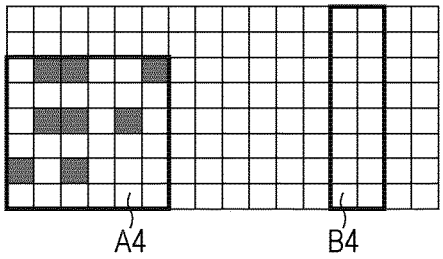
Figure 10F:
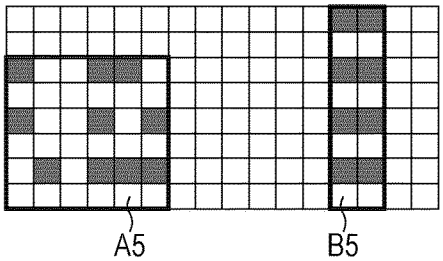
Figure 10G:
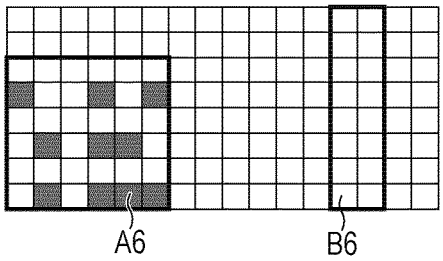
Figure 10H:
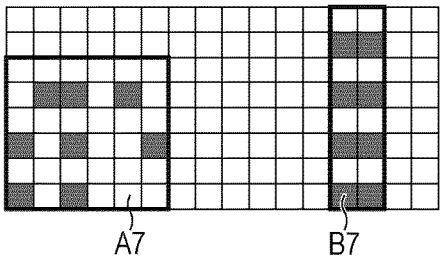
Figure 10H:
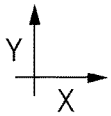

Note that FIGS. 10A and 10B illustrate such that ink ejection is set for the same position (the same raster) in the Y direction, but the ink is actually ejected to different positions in the Y direction. This is because the resolution of the recording data in the Y direction is 1200 dpi while the resolution corresponding to a distance between adjacent ones of the ejection ports of the ejection port column in the Y direction is 2400 dpi. For example, the raster at an end portion in the +Y direction is at the same position between FIGS. 10A and 10B on the recording data. However, the raster at the end portion in the +Y direction on the recording data of FIG. 10A corresponds to the ejection port of seg0 of the ejection port column 0 of FIG. 2, and the raster at the end portion in the +Y direction on the recording data of FIG. 10B corresponds to the ejection port of seg0 of the ejection port column 1 of FIG. 2. For this reason, the dots are actually formed at positions separated from each other in the Y direction by 2400 dpi.

As will be seen from A0, A1, A2, A3, A4, A5, A6 A7 of FIGS. 10A, 10B, 10C, 10D, 10E, 10F, and 10H, the ink is, for the image A with the second attribute (e.g., the image picture attribute), ejected from each of the ejection port columns 0 to 7 at a recording ratio of 25%. Since all of the ejection port columns 0 to 7 are used, the Y-direction resolution for dot formation is 2400 dpi. Thus, as described with reference to FIGS. 6C and 6D, the image picture attribute etc. can be recorded while unevenness in color density due to shifting of the dot formation positions is reduced.

On the other hand, as will be seen from B0, B1, B2, B3, B4, B5, B6, and B7 of FIGS. 10A, 10B, 10C, 10D, 10E, 10F, and 10H, the ink is, for the image B with the first attribute (e.g., the thin line image attribute), ejected only from each of the ejection port columns 1, 3, 5, and 7 at a recording ratio of 50%. Since the ejection port columns 0, 2, 4, and 6 are not used, the Y-direction resolution for dot formation is 1200 dpi. Thus, as described with reference to FIGS. 6A and 6B, the thin line image attribute can be recorded with excellent sharpness.

As described above, according to the present embodiment, recording can be, according to the image attribute, performed with sharpness while unevenness in color density is reduced.

Second Embodiment in the above-described first embodiment, the thin line image or the character image is determined as the first attribute, and other images than the thin line image and the character image, such as the image picture, are determined as the second attribute.

On the other hand, the present embodiment describes such a form that an edge portion of an image is determined as a first attribute and a non-edge portion is determined as a second attribute.

Note that description of contents similar to those of the above-described first embodiment will not be repeated.

In the present embodiment, the attribute information acquisition processing of step S4 illustrated in FIG. 4 is executed before the distribution processing of step S7 and after the index expansion processing of step 6. Thus, when the attribute information acquisition processing is performed, the index expansion processing has been already executed. Thus, at step S4, image data including two planes of information having a resolution of 1200 dpi×1200 dpi and including 1 bit for each value of CMYK is input.

Figure 11:
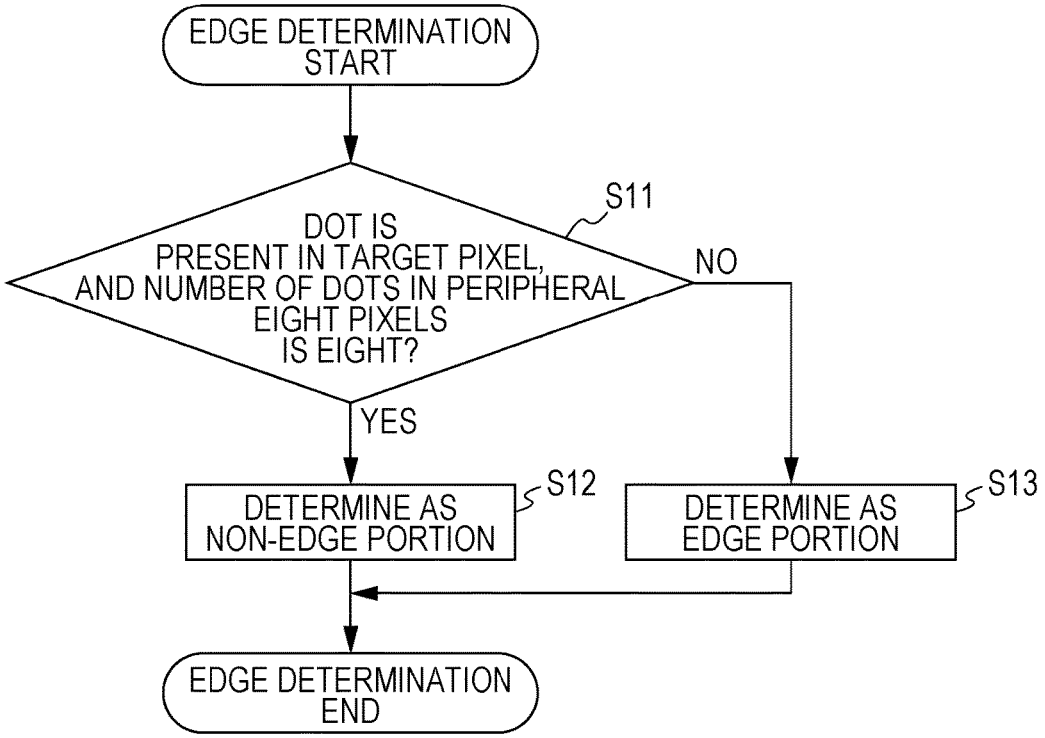
FIG. 11 is a flowchart for describing edge determination processing in another embodiment.

FIG. 11 is a flowchart of the process of edge determination processing executed in the present embodiment and performed in the attribute information acquisition processing of step S4.

When the edge determination processing begins, it is, at step S11, determined whether or not ink ejection is set for a certain target pixel with 1200 dpi×1200 dpi and whether or not ink ejection is also set for eight pixels around the target pixel. In other words, it is determined whether or not ink ejection is set for all of 3×3 pixels including the target pixel.

In a case where it is determined that ink ejection is set for all of the 3×3 pixels, the processing proceeds to step S12, and it is determined that the target pixel is the non-edge portion. Then, as in the case of other images (e.g., the image picture) than the character/thin line image in the first embodiment, "0" is assigned as attribute information.

On the other hand, in a case where in is determined that ink ejection is not set for any of the 3×3 pixels, the processing proceeds to step S13, and it is determined that the target pixel is the edge portion. Then, as in the case of the character/thin line image in the first embodiment, "1" assigned as the attribute reformation.

The subsequent processing is similar to that of the first embodiment. With this configuration, excellent sharpness can be provided at the edge portion of the image, and unevenness in color density due to shifting of dot formation positions can be reduced at the non-edge portion.

Third Embodiment

The present embodiment describes such a form that so-called non-ejection complementary processing as the processing of performing complementary recording by other ejection ports in a case where ejection failure occurs at a certain ejection port.

Note that description of contents similar to those of the above-described first and second embodiments will not be repeated.

Figure 12:
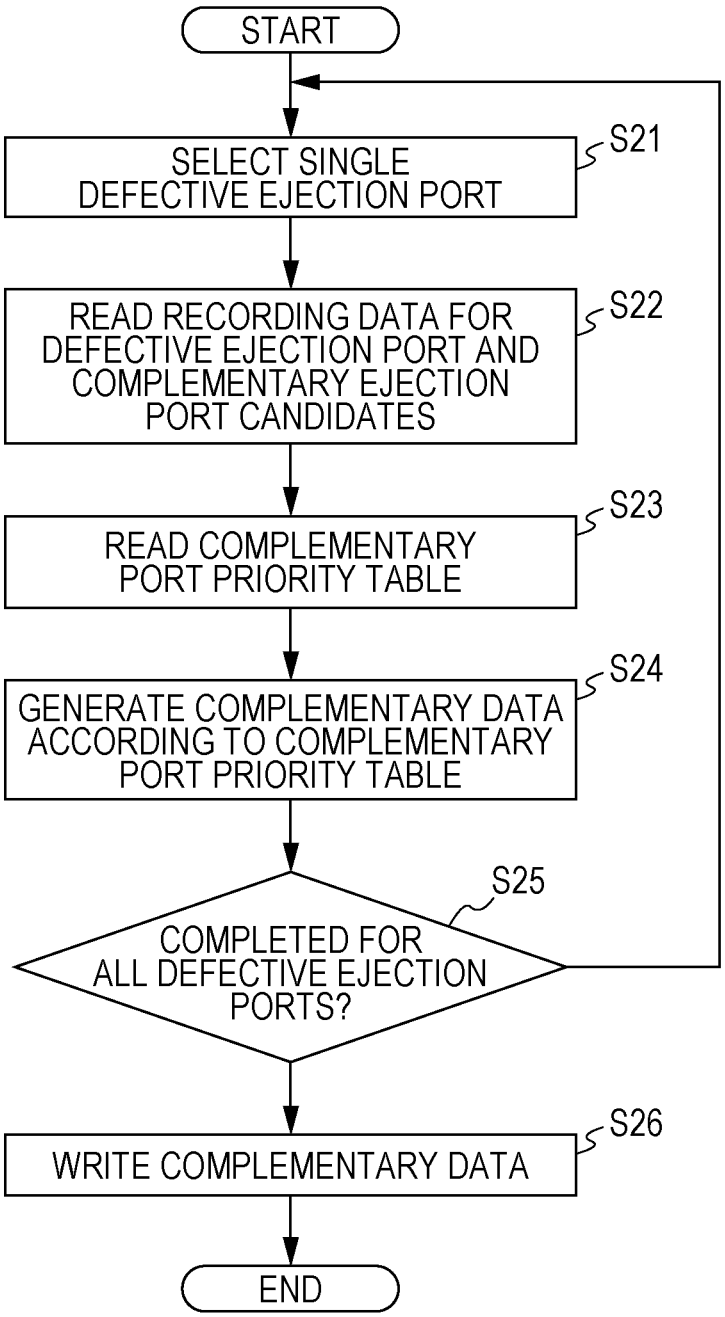
FIG. 12 is a flowchart for describing non-ejection complementary processing in still another embodiment.

FIG. 12 is a flowchart of the process of the non-ejection complementary processing executed in the present embodiment. Note that this non-ejection complementary processing may be performed at the timing of input of a recording job, or may be performed every time recording for a single page ends, for example.

First, at step S21, a single defective ejection port is selected from information stored in a buffer 136 and indicating defective ejection ports. The defective ejection port described herein is an ejection port which can no longer normally ejects ink due to an ejection port manufacturing error or ink clogging, leading to non-ejection of the ink, a decrease in an ejection amount, a change in an ejection direction, etc. Such a defective ejection port can be detected by various methods. For example, these methods include the method for recording a test pattern on a recording medium to check white spots of an image by a user, to specify a defective ejection port; and the method for reading, by an optical sensor, whether or not ink is actually ejected in a state in which data allowing ink ejection from all ejection ports has been input, to specify a defective ejection port. Information indicating the defective ejection port specified by these methods is stored in the buffer 136 in advance.

Next, at step S22, recording data for each of the defective ejection port and complementary ejection port candidates positioned in the same seg as that of the defective ejection port is read from the buffer 136. In a case where the recording data for the defective ejection port indicates non-ejection of the ink, the ink is not to be ejected in the first place even when ejection failure occurs, and therefore, later-described complementary data is not generated. On the other hand, in a case where the recording data for the defective ejection port indicates ink ejection, there is a probability that the ink cannot be normally ejected from the defective ejection port based on such recording data. Thus, the complementary data for complementary recording for a pixel, for which recording is supposed to be performed from the defective ejection port, by any of the complementary ejection port candidates is generated.

Next, at step S23, a complementary port priority table for determining an ejection port to be preferentially selected as a complementary ejection port from the complementary ejection port candidates is read. In the complementary port priority table, the order of priority for determining the complementary ejection port in a case where ejection failure occurs is set for each column at the same position in the X direction. This complementary port priority table will be described later in detail.

Next, at step S24, the single complementary ejection port is determined from the complementary ejection port candidates according to the order of priority set by the complementary port priority table, and the complementary data for the recording data corresponding to the defective ejection port is generated. Regarding the complementary ejection port, ejection ports satisfying both of two conditions including a condition where the ejection ports are not defective ejection ports and a condition where non-ejection of the ink is set by the recording data are searched from the complementary ejection port candidates, and the highest-priority complementary ejection port candidate is determined as the complementary port according to the order of priority in the complementary port priority table. Then, information indicating ink ejection set by the recording data corresponding to the defective ejection port is moved (replaced) to the complementary ejection port. In this manner, the complementary data corresponding to the complementary ejection port is generated. Thus, for the pixel for which ejection is supposed to be performed from the defective ejection port, the complementary ejection port belonging to the same seg as the defective ejection port can perform ejection instead, and lowering of an image quality due to ejection failure can be reduced.

Then, at step S25, it is determined whether or not the complementary data has been generated for all of the defective ejection ports. When it is determined that the defective ejection ports still remain, the processing returns to step S21, and similar processing is performed for the remaining defective ejection ports. When it is determined that she processing has completed for all of the defective ejection ports, the non-ejection complementary processing ends.

In the present embodiment, the complementary data is generated using different complementary port priority tables according to an image attribute.

Figures 13A, 13B, 13C, 13D:
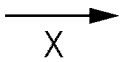
FIGS. 13A, 13B, 13C, and 13D are views of a complementary port priority table in the embodiment.

FIGS. 13A, 13B, 13C, and 13D illustrate the complementary port priority table used in a case where the image attribute a second attribute (e.g., an image picture attribute). FIG. 13A is the complementary port priority table used when the defective ejection port is caused in any of the ejection port columns 0 and 4 of FIG. 2. Similarly, FIG. 13B illustrates the complementary port priority table used when the defective ejection port is caused in any of the ejection port columns 1 and 5, FIG. 13C illustrates the complementary port priority table used when the defective ejection port is caused in any of the ejection port columns 2 and 6, and FIG. 13D illustrates the complementary port priority table used when the defective ejection port is caused in any of the ejection port columns 3 and 7. Note that in each of FIGS. 13A, 13B, 13C, and 13D, a first column (o) from the −X direction indicates the order of priority applied to a case where image data belongs to an odd-numbered column, and a first column (e) from the +X direction indicates the order of priority applied to a case where the image data belongs to an even-numbered column.

For example, in the first column (o) from the −X direction as illustrated in FIG. 13A, the order of priority is set in the order of "0", "2", "4", "6", "1", "3", "5", and "7" from above. This means that for the image data for the odd-numbered column, in a case where the defective ejection port is caused in any of the ejection port columns 0 and 4, the complementary ejection port can be determined in the priority order of the ejection port columns 0, 4, 1, 3, 2, 6, 3, and 7.

As illustrated in FIGS. 13A, 13B, 13C, and 13D, the complementary port priority table corresponding to the second attribute is set such that the ejection port positioned close to the defective ejection port in the Y direction is preferentially determined as the complementary ejection port. This is because of the following reasons: an ejection port positioned closer to the defective ejection port in the Y direction can form a dot at a Y-direction position closer to the pixel for which ejection is supposed to be performed by the defective ejection port, and therefore, lowering of the image quality can be more reduced as compared to a case where no defective ejection port is caused.

Although there is a difference in the order of priority, the complementary port priority table corresponding to the second attribute is set to make determination on availability of use as the complementary ejection port for the ejection ports of all of the ejection port columns 0 to 7. This is because of the following reasons: image sharpness is not required much in the case of recording other images than a thin line/character image, such as the image picture, and therefore, complementary recording by dot formation at positions different from each other to some degree in the Y direction does not lead to lowering of the image quality.

On the other hand, FIGS. 14A, 14B, 14C, and 14D illustrate the complementary port priority table used in a case where the image attribute is a first attribute (e.g., the thin line image). As in FIGS. 13A, 13B, 13C, and 13D, FIG. 14A illustrates the complementary port priority table used when the defective ejection port is caused in any of the ejection port columns 0 and 4, FIG. 14B illustrates the complementary port priority table used when the defective ejection port is caused in any of the ejection port columns 1 and 5, FIG. 14C illustrates the complementary port priority table used when the defective ejection port is caused in any of the ejection port columns 2 and 6, and FIG. 14D illustrates the complementary port priority table used when the defective ejection port is caused in any of the ejection port columns 3 and 7. Note that in each of FIGS. 14A, 14B, 14C, and 14D, a first column (o) from the −X direction also indicates the order of priority applied to a case where the image data belongs to the odd-numbered column, and a first column (e) from the +X direction also indicates the order of priority applied to a case where the image data belongs to the even-numbered column.

Unlike FIGS. 13A, 13B, 13C, and 13D, the order of priority is set only for some pixels in each column in FIGS. 14A, 14B, 14C, and 14D. For example, in the first column (o) from the −X direction as illustrated in FIG. 14A, the order of priority is set as "0" for a first pixel from above, and is set as "1" for a fifth pixel from above. The order of priority is not set for other pixels. This means as follows: for the image data for the odd-numbered column, in a case where the defective ejection port is caused in any of the ejection port columns 0 and 4, availability of use as the complementary ejection port can be determined in the priority order of the ejection port columns 0 and 4; but determination on availability of use as the complementary ejection port is not made for other ejection port columns 1 to 3 and 5 to 7.

As will be seen from FIGS. 14A, 14B, 14C, and 14D, in the complementary port priority table corresponding to the first attribute, determination on availability of use as the complementary ejection port can be made for the ejection port at the same position as that of the defective ejection port in the Y direction, but is not made for the ejection ports at different positions in the Y direction. Thus, when the image with the first attribute is recorded, even if the defective ejection port is caused, complementary recording is not performed by the ejection ports at the different positions in the Y direction. This is because sharpness is lowered as described with reference to FIG. 6B when dots are, for the thin line image or the character image, formed from the different positions in the Y direction.

When the complementary port priority table illustrated in FIGS. 14A, 14B, 14C, and 14D is used, complementary recording is not sometimes performed upon recording of the thin line image or the character image. As a result, there is a probability that the image is formed with a smaller number of dots than the number of dots supposed to be formed. For example, in a case where the image data indicating that the ejection ports belonging to seg0 of both of the ejection port columns 0 and 4 form dots in the X direction one by one is input, if the ejection port belonging to seg0 of the ejection port column 0 becomes the defective ejection port, only one dot might be formed from the ejection port belonging to seg0 of the ejection port column 4 even through two dots are supposed to be formed. However, even in this case, recording is performed from the ejection port belonging to seg0 of the ejection port column 4, and the image quality of the thin line image or the character image is not lowered much even though a color density is lowered. In this case, the image quality is, in an opposite way, greatly lowered when sharpness is lowered due to complementary recording by the ejection port positioned at the different position in the Y direction.

Because of the above-described reasons, the complementary port priority table is switched according to the image attribute in the present embodiment.

FIGS. 15A, 15B, 15C, 15D, 15E, 15F, 15G, and 15H and FIGS. 16A, 16B, 16C, 16D, 16E, 16F, 16G, and 16H are views for describing an example of the complementary data generated when the non-ejection complementary processing is performed in the present embodiment. Note that FIGS. 15A, 15B, 15C, 15D, 15E, 15F, 15G, and 15H schematically illustrate the recording data before the non-ejection complementary processing, and FIGS. 16A, 16B, 16C, 16D, 16E, 16F, 16G, and 16H schematically illustrate the complementary data after the non-ejection complementary processing. Note that a case where data similar to the recording data used in the first embodiment as illustrated in FIGS. 10A, 10B, 10C, 10D, 10E, 10F, 10G, and 10H is generated as the recording data will be described.

Description will be made below, assuming that ejection failure occurs at the ejection port 30 belonging to seg1 of the ejection port column 1 among the ejection ports 30 of the recording head illustrated in FIG. 2.

Figure 15A:
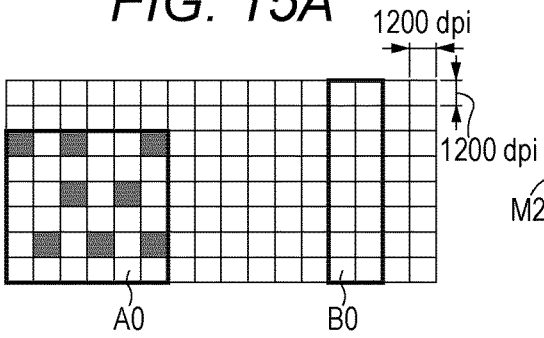
FIGS. 15A, 15B, 15C, 15D, 15E, 15F, 15G, and 15H are views of recording data before the non-ejection complementary processing in the embodiment.
Figure 15B:
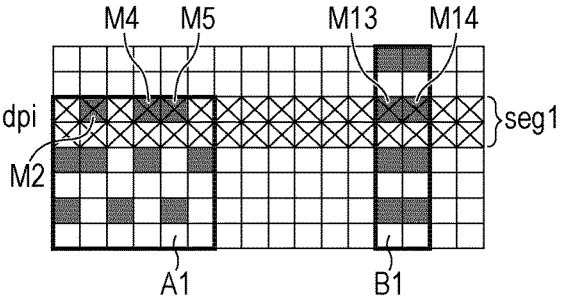
Figure 15C:
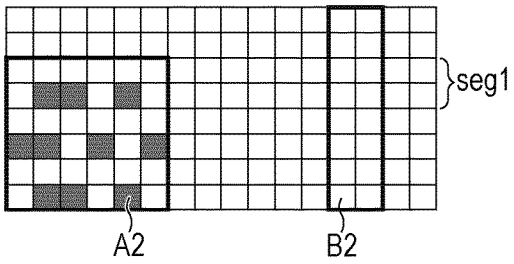
Figure 15D:
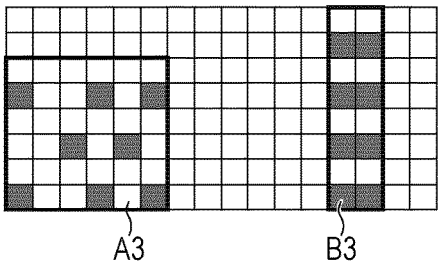
Figure 15E:
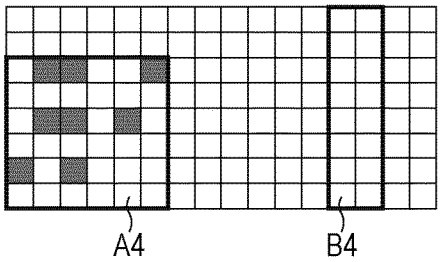

The ejection port column 1 corresponds to FIG. 15B of FIGS. 15A, 15B, 15C, 15D, 15E, 15F, 15G, and 15H on the recording data. Moreover, the ejection ports belonging to seg1 are those at positions shifting from a +Y-direction end portion in the −Y direction by 600 dpi, and the resolution of a single pixel of the recording data is 1200 dpi. Thus, the ejection ports belonging to seg1 correspond to third and fourth columns from the +Y direction in FIG. 15B. Thus, in a case where the ejection port belonging to seg1 of the ejection port column 1 becomes the defective ejection port, ejection failure actually occurs even when the recording data corresponding to the third and fourth columns from the +Y-direction end portion in FIG. 15B sets ink ejection (cross marks in FIG. 15B). As illustrated in FIG. 15B, ink ejection is set by recording data M2 for the second pixel, recording data M4 for the fourth pixel, recording data M5 for the fifth pixel, recording data M13 for the thirteenth pixel, and recording data M14 for the fourteenth pixel from a −X-direction end portion in the third column from the +Y-direction end portion. The non-ejection complementary processing is performed for these five types of recording data.

The recording data M2, the recording data M4, and the recording data M5 described herein are recording data corresponding to the second attribute (e.g., the image picture attribute). Thus, the complementary port priority table illustrated in FIGS. 13A, 13B, 13C, and 13D is used as described above. In this example, the defective ejection port belongs to the ejection port column 1, and therefore, the complementary port priority table illustrated in FIG. 13B is used.

Figure 15F:
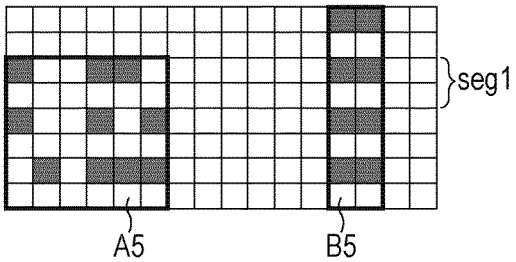
Figure 15G:
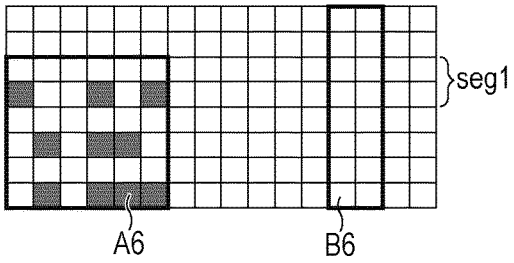
Figure 15H:
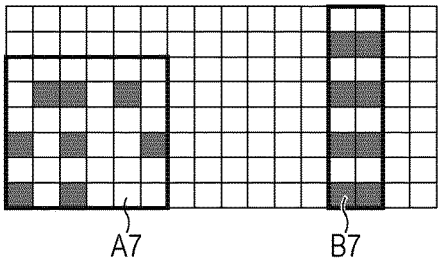
Figure 15H:
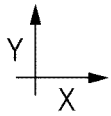
Figure 16A:
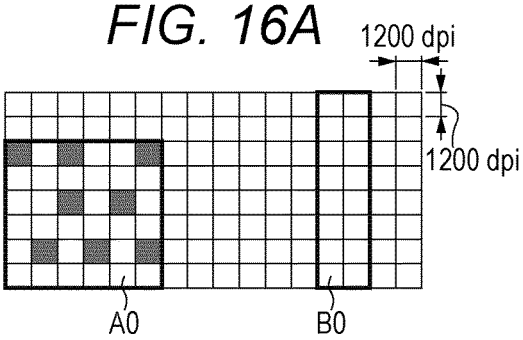
FIGS. 16A, 16B, 16C, 16D, 16E, 16F, 16G, and 16H are views of complementary data after the non-ejection complementary processing in the embodiment.
Figure 16B:
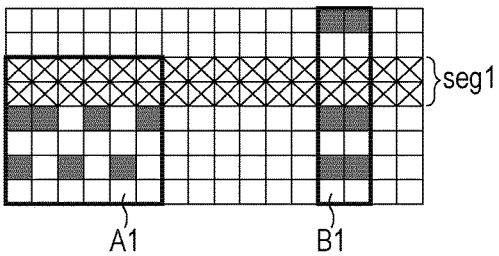
Figure 16C:
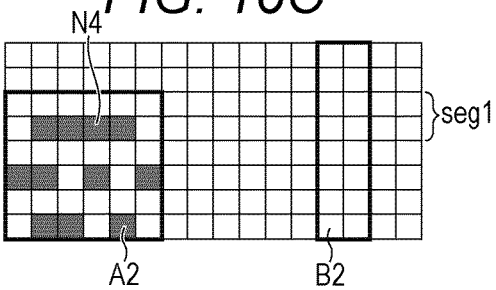
Figure 16D:
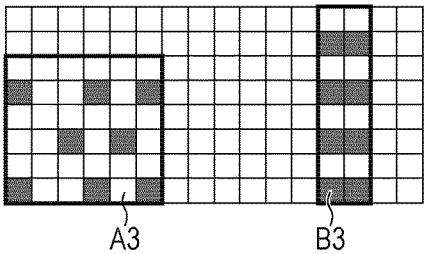
Figure 16E:
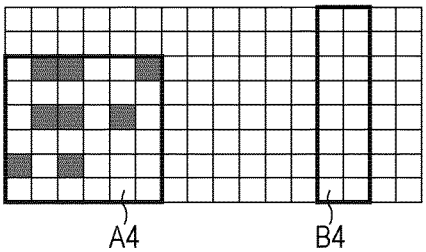
Figure 16F:
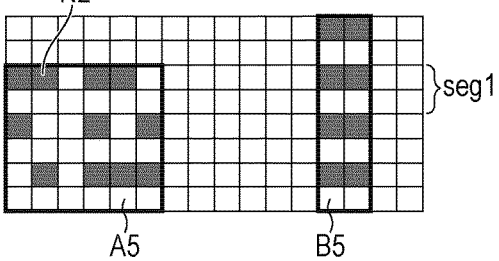

First, the recording data M2 is positioned in the even-numbered column, and therefore, the order of priority set for the first column (e) from the +X direction as illustrated in FIG. 13B is applied. Then, it is first determined whether or not the ejection port column 5 with a priority order of "0" includes an available complementary ejection port. From the recording data of FIG. 15F corresponding to the ejection port column 5, no recording data indicating ink ejection is set for the second pixel from the −X-direction end portion in the third column from the +Y-direction end portion, the third column corresponding to seg1. Thus, for the second pixel from the −X-direction end portion, the ejection port belonging to seg1 of the ejection port column 5 is determined as the available complementary ejection port. Thus, as illustrated in FIG. 16F, complementary data N2 setting ink ejection is generated for the second pixel from the −X-direction end portion in the third column from the +Y-direction end portion, the third column corresponding to seg1 of the ejection port column 5.

Next, the recording data M4 is positioned in the even-numbered column, and therefore, the order of priority set for the first column (e) from the +X direction as illustrated in FIG. 13B is applied. It is first determined whether or not the ejection port column 5 with a priority order of "0" includes an available complementary ejection port. From the recording data of FIG. 15F corresponding to the ejection port column 5, the recording data indicating ink ejection has been already set for the fourth pixel from the −X-direction end portion in the third column from the +Y-direction end portion, the third column corresponding to seg1. Thus, for the fourth pixel from the −X-direction end portion, the ejection port belonging to seg1 of the ejection port column 5 is not determined as the available complementary ejection port.

Next, is determined whether or not the ejection port column 1 with a priority order of "1" includes an available complementary ejection port. However, in this example, the ejection port belonging to seg1 of the ejection port column 1 is the defective ejection port, and in a similar manner, such an ejection port is not determined as the available complementary ejection port.

Next, it is determined whether or not the ejection port column 6 with priority order "2" includes an available complementary ejection port. From the recording data of FIG. 15G corresponding to the ejection port column 6, the recording data indicating ink ejection has been already set for the fourth pixel from the −X-direction end portion in the fourth column from the +Y-direction end portion, the fourth column corresponding to seg1. Thus, for the fourth pixel from the −X-direction end portion, the ejection port belonging to seg1 of the ejection port column 6 is not determined as the available complementary ejection port.

Then, it is determined whether or not the ejection port column 2 with a priority order of "3" includes an available complementary ejection port. From the recording data of FIG. 15C corresponding to the ejection port column 2, no recording data indicating ink ejection is set for the fourth pixel from the −X-direction end portion in the fourth column from the +Y-direction end portion, the fourth column corresponding to seg1. Thus, as illustrated in FIG. 16C, complementary data N4 setting ink ejection is generated for the fourth pixel from the −X-direction end portion in the fourth column from the +Y-direction end portion, the fourth column corresponding to seg1 of the ejection port column 2.

Next, the recording data M5 is positioned in the odd-numbered column, and therefore, the order of priority set for the first column (o) from the −X direction as illustrated in FIG. 13B is applied. It is first determined whether or not the ejection port column 1 with a priority order of "0" includes an available complementary ejection port. However, in this example, the ejection port belonging to seg1 of the ejection port column 1 is the defective ejection port, and therefore, such an ejection port is not determined as the available complementary ejection port.

Next, it is determined whether or not the ejection port column 5 with a priority order of "1" includes an available complementary ejection port. From the recording data of FIG. 15F corresponding to the ejection port column 5, the recording data indicating ink ejection has been already set for the fifth pixel from the −X-direction end portion in the third column from the +Y-direction end portion, the third column corresponding to seg1. Thus, for the fifth pixel from the −X-direction end portion, the ejection port belonging to seg1 of the ejection port column 5 is not determined as the available complementary ejection port.

Next, it is determined whether or not the ejection port column 2 with a priority order of "2" includes an available complementary ejection port. From the recording data of FIG. 15C corresponding to the ejection port column 2, the recording data indicating ink ejection has been already set for the fifth pixel from the −X-direction end portion in the fourth column from the +Y-direction end portion, the fourth column corresponding to seg1. Thus, for the fifth pixel from the −X-direction end portion, the ejection port belonging to seg1 of the ejection port column 2 is not determined as the available complementary ejection port.

Figure 16G:
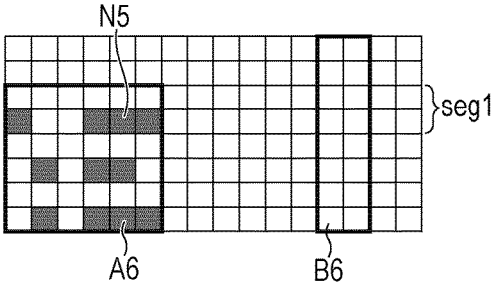
Figure 16H:
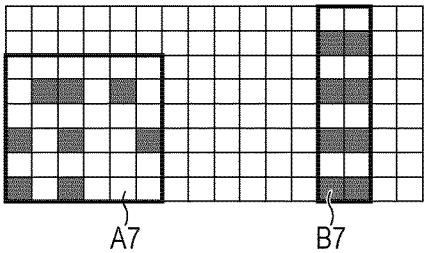
Figure 16H:
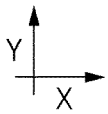
Figure 17:
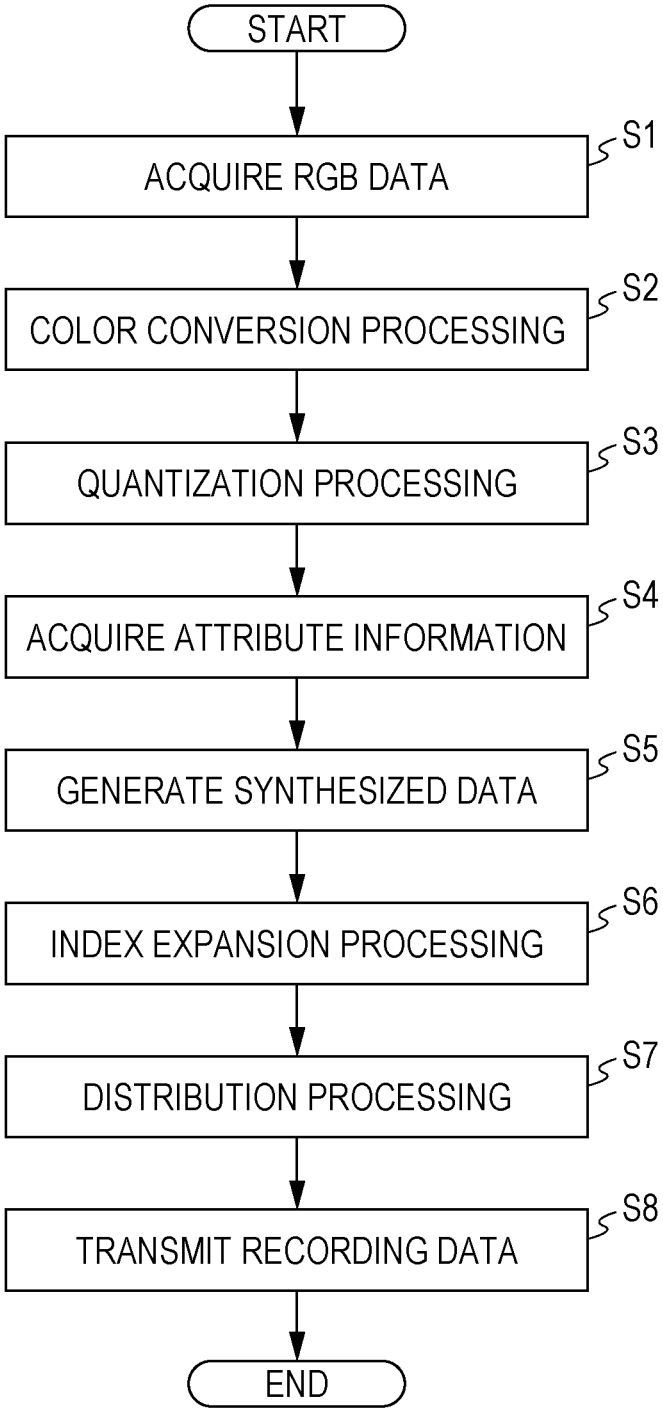
FIG. 17 is a flowchart for describing the process of image processing in the embodiment.

Then, it is determined whether or not the ejection port column 6 with a priority order of "3" includes an available complementary ejection port. From the recording data FIG. 15G corresponding to the ejection port column 6, no recording data indicating ink ejection is set for the fifth pixel from the −X-direction end portion in the fourth column from the +Y-direction end portion, the fourth column corresponding to seg1. Thus, as illustrated in FIG. 16G, complementary data N5 setting ink ejection is generated for the fifth pixel from the −X-direction end portion in the fourth column from the +Y-direction end portion, the fourth column corresponding to seg1 of the ejection port column 6.

As described above, the complementary data N2, N4, and N5 is generated in the ejection port columns 5, 2, and 6 for the recording data M2, M4, and M5 corresponding to an image A with the second attribute (the image picture attribute), and complementary recording is performed. Of these types of recording, recording from the ejection port column 5 based on the complementary data N2 can form a dot at the same position in the Y direction as that of the ejection port belonging to seg1 of the ejection port column 1, but recording from other ejection port columns 2 and 6 based on the complementary data N4 and N5 forms dots at different positions in the Y direction. However, the image A has the second attribute, and therefore, sharpness is not emphasized much. Thus, the image quality is not greatly lowered.

On the other hand, the recording data M13 and M14 is recording data corresponding to the first attribute (e.g., the thin line image). Thus, the complementary port priority table illustrated in FIGS. 14A, 14B, 14C, and 14D is used as described above. In this example, the defective ejection port belongs to the ejection port column 1, and therefore, the complementary port priority table illustrated in FIG. 14B is used.

First, the recording data M13 is positioned in the odd-numbered column, and therefore, the order of priority set for the first column (o) from the −X direction as illustrated in FIG. 14B is applied. It is first determined whether or not the ejection port column 1 with a priority order of "0" includes an available complementary ejection port. However, the ejection port belonging to seg1 of the ejection port column 1 is the defective ejection port, and for this reason, it is determined that complementary recording is not available.

Next, it is determined whether or not complementary recording is available for the ejection port column 5 with a priority order of "1". As illustrated in FIG. 15F corresponding to the ejection port column 5, the recording data indicating ink ejection has been already set for the thirteenth pixel from the −X direction in the third column from the +Y-direction end portion, the third column corresponding to seg1. Thus, it is determined that complementary recording is not available.

In this example, the order of priority is set only as "0" and "1" in the complementary port priority table illustrated in FIG. 14B. The ejection ports corresponding to these priority orders are not determined as the available complementary ejection ports at this stage, and for this reason, no complementary data is generated for the recording data M13.

Note that although not described herein, no complementary data is also generated for the recording data M14.

This is because the recording data M13 and M14 corresponds to an image B as a first image (e.g., the thin line image). As described above, in a case where sharpness of the thin line image or the character image is emphasized, sharpness can be more held in the case of not performing complementary recording than in the case of performing complementary recording by the ejection port at the different position in the Y direction. Thus, a preferable image quality is provided.

As described above, according to the present embodiment, image sharpness can be held while the non-ejection complementary processing can be performed.

Other Embodiments

Each embodiment described above describes such a form that the image data corresponding to the first attribute (e.g., the thin line image) is distributed only to the odd-numbered ejection port columns 1, 3, 5, and 7. However, even in such a form that the image data is distributed only to the even-numbered ejection port columns 0, 2, 4, and 6, excellent sharpness can be provided. In a case where the image data with the first attribute is input, when the image data is, upon recording, constantly distributed only to the odd-numbered ejection port columns 1, 3, 5, and 7 or only to the even-numbered ejection port columns 0, 2, 4, and 6, the ejection ports of the same ejection port columns are always used for recording. This easily leads to lowering of performance of these ejection ports associated with use thereof. For this reason, the mask pattern group is switched between the mask pattern group for distribution only to the odd-numbered ejection port columns 1, 3, 5, and 7 and the mask pattern group for distribution only to the even-numbered ejection port columns 0, 2, 4, and 6 periodically at predetermined timing, and in this manner, lowering of performance due to intensive use of only the specific ejection port columns as described above can be reduced. This predetermined timing can be various types of timing such as the timing of switching a recording page or the timing of switching an input job.

Moreover, each embodiment described above includes such a form that the recording head including the eight ejection port columns is used, but a recording head including 12 or 24 ejection port columns may alternatively be used, for example.

Further, each embodiment described above includes such a form that recording is performed only by the odd-numbered ejection port columns 1, 3, 5, and 7 or only by the even-numbered ejection port columns 0, 2, 4, and 6 in the case of recording the image with the first attribute (e.g., the thin line image attribute) and is performed by all of the ejection port columns 0 to 7 in the case of recording the image with the second attribute (e.g., the image picture attribute), but the present invention may be implemented in other forms. For example, a difference in the recording ratio between the odd-numbered ejection port columns 1, 3, 5, and 7 and the even-numbered ejection port columns 0, 2, 4, and 6 in the case of processing the image data with the first attribute (e.g., the thin line image attribute) may be greater than that in the case of processing the image data with the second attribute (e.g., the image picture attribute). In the case of processing the image data with the first attribute (e.g., the thin line image attribute), the recording ratio of each of the odd-numbered ejection port columns 1, 3, 5, and 7 is 50%, and the recording ratio of each or the even-numbered ejection port columns 0, 2, 4, and 6 is 0%. Thus, the above-described difference is 200 (50×4−0×4) %. Moreover, in the case of processing the image data with the second attribute (e.g., the image picture attribute), the recording ratio of each of the odd-numbered ejection port columns 1, 3, 5, and 7 is 25%, and the recording ratio of each of the even-numbered ejection port columns 0, 2, 4 and 6 is 25%. Thus, the above-described difference is 0 (25×4−25×4) %. Thus, the above-described conditions are satisfied.

In addition, each embodiment described above has a case where the resolution of the ejection port column is 2400 dpi and the resolution of the recording data is 1200 dpi, i.e., a case where the resolution of the recording data is lower than that of the ejection port column. However, both of the ejection port column and the recording data have a resolution of 2400 dpi. Note that in this case, the resolution of the recording data is high, and for this reason, there is a probability that a data processing load increases. As long as the resolution of the recording data is lower than that of the ejection port column as described, unevenness in color density due to landing position shifting upon recording of the image with the second attribute can be reduced without a load increase.

Moreover, each embodiment described above has the recording device and the recording method using the recording device. However, the present invention can also be applicable to an image processing device or an image processing method for generating data for the recording method described in each embodiment. Moreover, the present invention can also be applicable to such a form that a program for performing a recording method described above is prepared separately from the recording device.

According to an aspect of the recording device of the present invention, in the case of using the recording head configured such that the multiple ejection port columns shift from each other in the arraying direction, recording with reduced non-sharpness and recording with reduced unevenness in color density can be performed according to the image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-072377, filed Mar. 31, 2017, which is hereby incorporated by reference herein in its entirety.

What is claimed is:

1. An image processing apparatus for a recording device to record an image to recording medium using a recording head, wherein the recording head has a first ejection port column configured such that multiple ejection ports for a first color ink ejection are arrayed in a predetermined direction, and having a second ejection port column configured such that multiple ejection ports for the first color ink ejection are arrayed at a same interval as an interval of the multiple ejection ports of the first ejection port column in the predetermined direction, the second ejection port column being shifted to the first ejection port column in a crossing direction crossing the predetermined direction, one of the ejection ports included in the second ejection port column being arranged between two ejection ports adjacent in the first ejection port column in the predetermined direction, wherein the image processing apparatus comprises:

an acquisition unit configured to acquire image data including a pixel value for each pixel of the image and attribute information indicating an attribute of the image; and a generation unit configured to generate recording data by distributing the image data to the first and second ejection port columns based on the attribute information, and wherein the generation unit generates the recording data by distributing the image data such that a difference in a recording ratio between the first ejection port column and the second ejection port column is greater in a case where the attribute information indicates a first attribute than in a case where the attribute information indicates a second attribute different from the first attribute.

2. The image processing apparatus according to claim 1, wherein in the case where the attribute information indicates the second attribute, the generation unit generates the recording data such that the recording ratio of the first ejection port column and the recording ratio of the second ejection port column are roughly equal to each other.

3. The image processing apparatus according to claim 1, wherein in the case where the attribute information indicates the first attribute, the generation unit generates the recording data such that the recoding ratio of the second ejection port column is roughly 0%.

4. The image processing apparatus according to claim 1, wherein in the case where the attribute information indicates the first attribute, the generation unit generates the recording data such that the recording ratio of the second ejection port column is roughly 0% until a predetermined timing, and the recording ratio of the first ejection port column is roughly 0% after the predetermined timing.

5. The image processing apparatus according to claim 4, wherein the recording ratio of the second ejection port column and the recording ratio of the first ejection port column are switched each other at a predetermined number of recording pages.

6. The image processing apparatus according to claim 4, wherein the recording ration of the second ejection port column and the recording ratio of the first ejection port column are switched each other at a predetermined number of input jobs.

7. The image processing apparatus according to claim 1, wherein the first ejection port column includes a first ejection port and a fifth ejection port adjacent to the first ejection port in the predetermined direction, the second ejection port column includes a second ejection port, which is positioned closest to the first ejection port in the multiple ejection ports of the second ejection port column in the predetermined direction, the recording head further includes a third ejection port column and a fourth ejection port column each configured such that multiple ejection ports for ink ejection are arrayed at a same interval as the interval of the multiple ejection ports of the first ejection port column in the predetermined direction, one of the ejection ports included in the third ejection port column and one of the ejection ports included in the fourth ejection port column being arranged between two ejection ports adjacent in the first ejection port column in the predetermined direction, and in the recording head, the first, second, third and fourth ejection port columns are arranged in this order, and each ejection port is arranged in the predetermined direction in an order of the first ejection port, the second ejection port, the third ejection port, the fourth ejection port, and the fifth ejection port.

8. The image processing apparatus according to claim 7, wherein the generation unit generates the recording data such that the recording ratio is roughly equal among the first ejection port column, the second ejection port column, the third ejection port column, and the fourth ejection port column in the case where the attribute information indicates the second attribute, and the recording ratios of the second ejection port column and the fourth ejection port column are roughly 0% in the case where the attribute information indicates the first attribute.

9. The image processing apparatus according to claim 1, wherein the acquisition unit acquires the attribute information indicating the second attribute as the image attribute in a case where the image corresponds to any of an image picture and a non-edge portion, and wherein the acquisition unit acquires the attribute information indicating the first attribute as the image attribute in a case where the image corresponds to any of a thin line image, a character image, and an edge portion.

10. The image processing apparatus according to claim 1, further comprising:

a complementing unit configured to determine, in a case where the recording data corresponds to a defective ejection port that causes ejection failure and is included in the first ejection port column, a complementary ejection port among ejection ports included in the second ejection port column to perform complementary recording for the defective ejection port, the complementary ejection port being an ejection port arrayed at a position corresponding to the defective ejection port in the predetermined direction in a case where the attribute information indicates the second attribute.

11. The image processing apparatus according to claim 1, wherein the image data includes information for setting ejection or non-ejection of the ink for each pixel.

12. The image processing apparatus according to claim 1, wherein a resolution of the recording data in the predetermined direction is lower than a resolution corresponding to a distance between a first ejection port included in the first ejection port column and a second ejection port included in the second ejection port arranged closest to the first ejection port in the predetermined direction.

13. The image processing apparatus according to claim 1, further comprising:

a control unit configured to control, according to the recording data, the recording head to eject ink from the first and second ejection port columns to the recording medium.

14. An image processing method for performing recording an image to recording medium using a recording head having a first ejection port column configured such that multiple ejection ports for a first color ink ejection are arrayed in a predetermined direction, and having a second ejection port column configured such that multiple ejection ports for the first color ink ejection are arrayed at a same interval as an interval of the multiple ejection ports of the first ejection port column in the predetermined direction, the second ejection port column being shifted to the first ejection port column in a crossing direction crossing the predetermined direction, one of the ejection ports included in the second ejection port column being arranged between two ejection ports adjacent in the first ejection port column-in the predetermined direction, the image processing method comprising:

an acquisition step of acquiring image data indicating values for each pixel of the image and attribute information indicating an attribute of the image; and a generation step of generating recording data by distributing the image data to the first and second ejection port columns based on the attribute information, wherein, in the generation step, the recording data is generated such that a difference in a recording ratio between the first ejection port column and the second ejection port column is greater in a case where the attribute information indicates a first attribute than in a case where the attribute information indicates a second attribute different from the first attribute.

15. The image processing method according to claim 14, wherein in the case where the attribute information indicates the second attribute, the generation unit generates the recording data such that the recording ratio of the first ejection port column and the recording ratio of the second ejection port column are roughly equal to each other.

16. The image processing method according to claim 14, wherein in the case where the attribute information indicates the first attribute, the generation unit generates the recording data such that the recording ratio of the second ejection port column is roughly 0%.

17. The image processing method according to claim 14, wherein in the case where the attribute information indicates the first attribute, the generation unit generates the recording data such that the recording ratio of the second ejection port column is roughly 0% until a predetermined timing, and the recording ratio of the first ejection port column is roughly 0% after the predetermined timing.

18. The image processing method according to claim 14, wherein the recording ratio of the second ejection port column and the recording ratio of the first ejection port column are switched each other at a predetermined number of recording pages.

19. The image processing method according to claim 14, wherein the recording ratio of the second ejection port column and the recording ratio of the first ejection port column are switched each other at a predetermined number of input jobs.

20. The image processing method according to claim 14, wherein the first ejection port column includes a first ejection port and a fifth ejection port adjacent to the first ejection port in the predetermined direction, the second ejection port column includes a second ejection port, which is positioned closest to the first ejection port in the multiple ejection ports of the second ejection port column in the predetermined direction, the recording head further includes a third ejection port column and a fourth ejection port column each configured such that multiple ejection ports for ink ejection are arrayed at a same interval as the interval of the multiple ejection ports of the first ejection port column in the predetermined direction, one of the ejection ports included in the third ejection port column and one of the ejection ports included in the fourth ejection port column arranged between two ejection ports adjacent in the first ejection port column in the predetermined direction, and in the recording head, the first, second, third and fourth ejection port columns are arranged in this order, and each ejection port is arranged in the predetermined direction in an order of the first ejection port, the second ejection port, the third ejection port, the fourth ejection port, and the fifth ejection port.

* * * * *